US008139012B2

(12) United States Patent
Fukui et al.

(10) Patent No.: US 8,139,012 B2
(45) Date of Patent: Mar. 20, 2012

(54) LIQUID-CRYSTAL-DEVICE DRIVING METHOD, LIQUID CRYSTAL DEVICE, AND ELECTRONIC APPARATUS

(75) Inventors: Kosuke Fukui, Suwa (JP); Hiroyuki Hosaka, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 396 days.

(21) Appl. No.: 11/742,139

(22) Filed: Apr. 30, 2007

(65) Prior Publication Data

US 2007/0252803 A1 Nov. 1, 2007

(30) Foreign Application Priority Data

May 1, 2006 (JP) ..... 2006-127412

(51) Int. Cl.
*G09G 3/36* (2006.01)

(52) U.S. Cl. ..... 345/96; 345/58

(58) Field of Classification Search ..... None
See application file for complete search history.

(56) References Cited

U.S. PATENT DOCUMENTS 4,842,371 A * 6/1989 Yasuda et al. ..... 345/96
5,689,282 A * 11/1997 Wolfs et al. ..... 345/100
5,956,006 A * 9/1999 Sato ..... 345/88
6,069,620 A * 5/2000 Nakamura et al. ..... 345/214
2002/0084969 A1* 7/2002 Ozawa ..... 345/96
2004/0041760 A1* 3/2004 Tsumura et al. ..... 345/87
2004/0113879 A1* 6/2004 Sekiguchi et al. ..... 345/94
2004/0263466 A1* 12/2004 Song et al. ..... 345/100
2005/0227396 A1* 10/2005 Chang et al. ..... 438/30
2006/0244701 A1* 11/2006 Fukui ..... 345/87
2006/0274011 A1 12/2006 Igarashi et al.

FOREIGN PATENT DOCUMENTS

JP A 2001-033827 2/2001
WO WO 2005/081054 A1 9/2005

* cited by examiner

*Primary Examiner* — Alexander Eisen
*Assistant Examiner* — Matthew Yeung
(74) *Attorney, Agent, or Firm* — Oliff & Berridge, PLC

(57) ABSTRACT

A method of driving a liquid crystal device having an optically compensated bend mode and including an image display area including a plurality of pixels two-dimensionally arranged in a row direction in which a plurality of scanning lines extend and in a column direction in which a plurality of data lines extend. The method includes performing an initial transition of a liquid crystal alignment from a splay alignment to a bend alignment. The initial transition includes inversion driving for driving the plurality of pixels by using, among a plurality of inversion driving modes, one inversion driving mode for inverting relative polarities of voltages applied to the plurality of pixels, and different inversion driving for switching the inversion driving mode in the inversion driving to a different inversion driving mode before driving the plurality of pixels.

5 Claims, 21 Drawing Sheets

LIQUID-CRYSTAL-DEVICE DRIVING METHOD, LIQUID CRYSTAL DEVICE, AND ELECTRONIC APPARATUS

CROSS-REFERENCE TO RELATED APPLICATION

This application claims priority from Japanese Patent Application No. 2006-127412 filed in the Japanese Patent Office on May 1, 2006, the entire disclosure of which is hereby incorporated by reference in its entirety.

BACKGROUND

1. Technical Field

The present invention relates to, for example, an OCB-mode (optically compensated bend mode) liquid-crystal-device driving method, a liquid crystal device having an OCB mode, and an electronic apparatus including the liquid crystal device.

2. Related Art

In recent years, in the field of liquid crystal devices typified by liquid crystal television sets, etc., OCB-mode liquid crystal devices that have fast response speeds for the purpose of improving moving image quality have attracted lots of attention. In the OCB mode, in an initial state, liquid crystal molecules are in a splay alignment in which the liquid crystal molecules splay between a pair of substrates. Accordingly, at a displaying time, the liquid crystal molecules need to be in a bend alignment in which the liquid crystal molecules bend. In other words, by modulating a transmittance at the displaying time on the basis of a bending level of the bend alignment, a fact response is realized. Therefore, in the case of an OCB-mode liquid crystal device, its liquid crystal is in the splay alignment. Thus, the liquid crystal device needs a so-called "initial transition operation" that, by applying a voltage whose value is not less than a threshold value to the liquid crystal when the liquid crystal device is supplied with power, performs a transition of the alignment state of the liquid crystal from the splay alignment in the initial state to the bend alignment at the displaying time. If the initial transition is not sufficiently performed, a display defect may occur and a desired fast response may not be obtained.

Methods for performing the initial transition include a method that, by applying voltages having reverse polarities to two adjacent pixels (or wires) so that a horizontal electric field is generated therebetween, irregularity in alignment, that is, disclination, occurs in liquid crystal. As described above, by allowing the liquid crystal to be in a state in which a transition nucleus can easily be generated, a transition to the bend alignment is performed. However, when the applied voltage is approximately several voltages, approximately a time from ten and several seconds to several tens of seconds is needed to perform the initial transition operation.

Although, in this case, the time required for the initial transition operation can be reduced by applying a high voltage of approximately 20 volts, a problem occurs in that the reliability of the liquid crystal device deteriorates since application of the high voltage causes a large load on the liquid crystal device. Accordingly, an initial transition method (see, for example, JP-A-2001-33827) that reduces the initial transition time by oscillating liquid crystal with a voltage of approximately several volts applied to the liquid crystal, has been proposed. In this method, by providing a liquid crystal device with an oscillator, and driving the oscillator, a transition of the alignment state of the liquid crystal from the splay alignment to the bend alignment is performed, with a transition nucleus used as a base.

However, the above initial transition method of the related art also has a problem in that the liquid crystal device is expensive since the liquid crystal device needs to include the oscillator.

SUMMARY

Some exemplary embodiments include a liquid-crystal-device driving method and liquid crystal device that performs a fast initial transition without using additional members, and an electronic apparatus including the liquid crystal device.

According to an embodiment of the invention, there is provided a method for driving a liquid crystal device having an optically compensated bend mode and including an image display area including a plurality of pixels two-dimensionally arranged in a row direction in which a plurality of scanning lines extend and in a column direction in which a plurality of data lines extend. The method includes performing an initial transition of a liquid crystal alignment from the splay alignment to the bend alignment. The initial transition includes inversion driving for driving the plurality of pixels by using, among a plurality of inversion driving modes, one inversion driving mode for inverting relative polarities of voltages applied to the plurality of pixels, and different inversion driving for switching the inversion driving mode in the inversion driving to a different inversion driving mode before driving the plurality of pixels.

According to exemplary embodiment, there is provided a liquid crystal device including an image display area including a plurality of pixels two-dimensionally arranged in a row direction in which a plurality of scanning lines extend and in a column direction in which a plurality of data lines extend, the liquid crystal device having an optically compensated bend mode for displaying an image by performing an initial transition of a liquid crystal alignment from the splay alignment to the bend alignment. The liquid crystal device includes an inversion driving unit that has a plurality of inversion driving modes for periodically inverting relative polarities of voltages applied to the plurality of pixels, and a switching unit that switches among the plurality of inversion driving modes at least once at a time of transition from the splay alignment to the bend alignment.

According to the method and the liquid crystal device, when voltages are applied to a plurality of pixels on the basis of one inversion driving mode, by switching the inversion driving mode to a different inversion driving mode, and fluctuating a liquid crystal alignment, a fast initial transition can be realized.

In other words, after, in one inversion driving mode, a transition nucleus in which a liquid crystal alignment has changed from the splay alignment to the bend alignment is generated, by switching the inversion driving mode to a different inversion driving mode, and fluctuating the liquid crystal alignment so that a transition nucleus grows, a fact transition of the state of the liquid crystal alignment in a different pixel can be performed. At a time of transition of the liquid crystal alignment, by switching between an inversion driving mode in which a transition nucleus can easily be generated and an inversion driving mode in which an alignment state of one pixel can easily be conducted to different pixels, with the transition nucleus as a base, merits of the one and different inversion driving modes can be combined. Accordingly, compared with the case of applying voltages to pixels on the basis of one inversion driving mode so that a transition of the alignment state of liquid crystal can be performed, the time required for initial transition can be reduced without using additional members.

In addition, the initial transition time can be reduced without increasing voltages applied to the pixels, thus preventing a load on the liquid crystal device from increasing and thus maintaining the reliability of the liquid crystal device.

Preferably, the plurality of inversion driving modes include at least two inversion driving modes among a gate-line inversion-driving mode for applying voltages having relatively identical polarities to, among the plurality of pixels, a set of pixels forming one row, and applying voltages having relatively reverse polarities to sets of pixels forming two different rows adjacent to the one row, a source-line inversion-driving mode for applying voltages having relatively identical polarities to, among the plurality of pixels, a set of pixels forming one column, and applying voltages having relatively reverse polarities to sets of pixels forming two different columns adjacent to the one column, a frame inversion-driving mode for applying voltages having relatively identical polarities to all the plurality of pixels, and a dot inversion-driving mode for applying voltages having relatively reverse polarities to pixels adjacent to one pixel among the plurality of pixels.

In the method and the liquid crystal device, by using the inversion driving modes and switching among the inversion driving modes, as described above, the initial transition time can be reduced.

In the gate-line inversion driving, by applying voltages having reverse polarities to two adjacent rows, two adjacent pixels in the column direction have a large potential difference. Thus, a strong horizontal electric field is generated between adjacent pixels in the column direction, so that disclination can easily occurs in the liquid crystal. Accordingly, a transition nucleus can easily be generated. However, it is difficult for a transition state to be conducted in the column direction since adjacent pixels in the column direction have the large potential difference.

In addition, in the source-line inversion driving, similarly to the gate-line inversion driving, a transition nucleus can easily be generated in liquid crystal since a strong horizontal electric field is generated between two adjacent pixels in the row direction. However, it is difficult for a transition state to be conducted in the row direction since adjacent pixels in the row direction have a large potential difference.

Since, in the frame inversion driving, voltages having identical polarities are applied to all the pixels, adjacent pixels have a weak horizontal electric field. Thus, a generated transition nucleus can easily be conducted to different pixels. However, the weak horizontal electric field makes it difficult to generate the transition nucleus.

In the dot inversion driving, similarly to the gate-line inversion driving and the source-line inversion driving, a transition nucleus can easily be generated in liquid crystal since a strong horizontal electric field is generated between two adjacent pixels. However, it is difficult for the transition state to be conducted since adjacent pixels in the column direction and the row direction have a large potential difference.

In addition, preferably, in the method, the plurality of inversion driving modes include the gate-line inversion-driving mode and the frame inversion-driving mode, and, in the initial transition, the gate-line inversion-driving mode is switched to the frame inversion-driving mode.

In the method and the liquid crystal device, by initially applying voltages to a plurality of pixels on the basis of the gate-line inversion-driving mode, transition nuclei are easily generated in the pixels in distributed form. After that, by applying voltages to the pixels on the basis of the frame inversion-driving mode, a transition state of each transition nucleus generated is conducted to different pixels in a short time, with the transition nucleus as a base. Therefore, the time required for initial transition of liquid crystal can be reduced.

Furthermore, even if, after applying voltages on the basis of the frame inversion-driving mode, voltages are applied on the basis of the gate-line inversion-driving mode, as described above, the time required for initial transition can be reduced. In other words, by applying voltages to a plurality of pixels in frame inversion driving, transition nuclei are generated in the pixels in the column direction in distributed form. In addition, compared with the case of using a strong horizontal electric field between two adjacent pixels, it is difficult for the transition nuclei to be generated in frame inversion driving. However, the plurality of pixels are in a state close to a transition nucleus state. After that, by applying voltages to the pixels on the gate-line inversion-driving mode, a transition state can be conducted in the row direction in a short time. Therefore, the time required for initial transition of liquid crystal can be reduced.

In the gate-line inversion-driving mode, polarities of applied voltages are alternately changed for each row. Thus, compared with the case of inverting the polarities for each pixel, the load on the liquid crystal device can be reduced.

According to another exemplary embodiment, there is provided an electronic apparatus including the above-described liquid crystal device.

As described above, when voltages are applied to a plurality of pixels on the basis of one inversion driving mode, by switching the inversion driving mode to a different inversion driving mode, the time required for initial transition can be reduced without using additional members, compared with the case of performing transition of the alignment state of liquid crystal by applying voltages to the pixels on the basis of one inversion driving mode.

BRIEF DESCRIPTION OF THE DRAWINGS

Exemplary embodiments will be described with reference to the accompanying drawings, wherein like numbers reference like elements.

DETAILED DESCRIPTION OF EMBODIMENTS

First Embodiment

Figure 1:
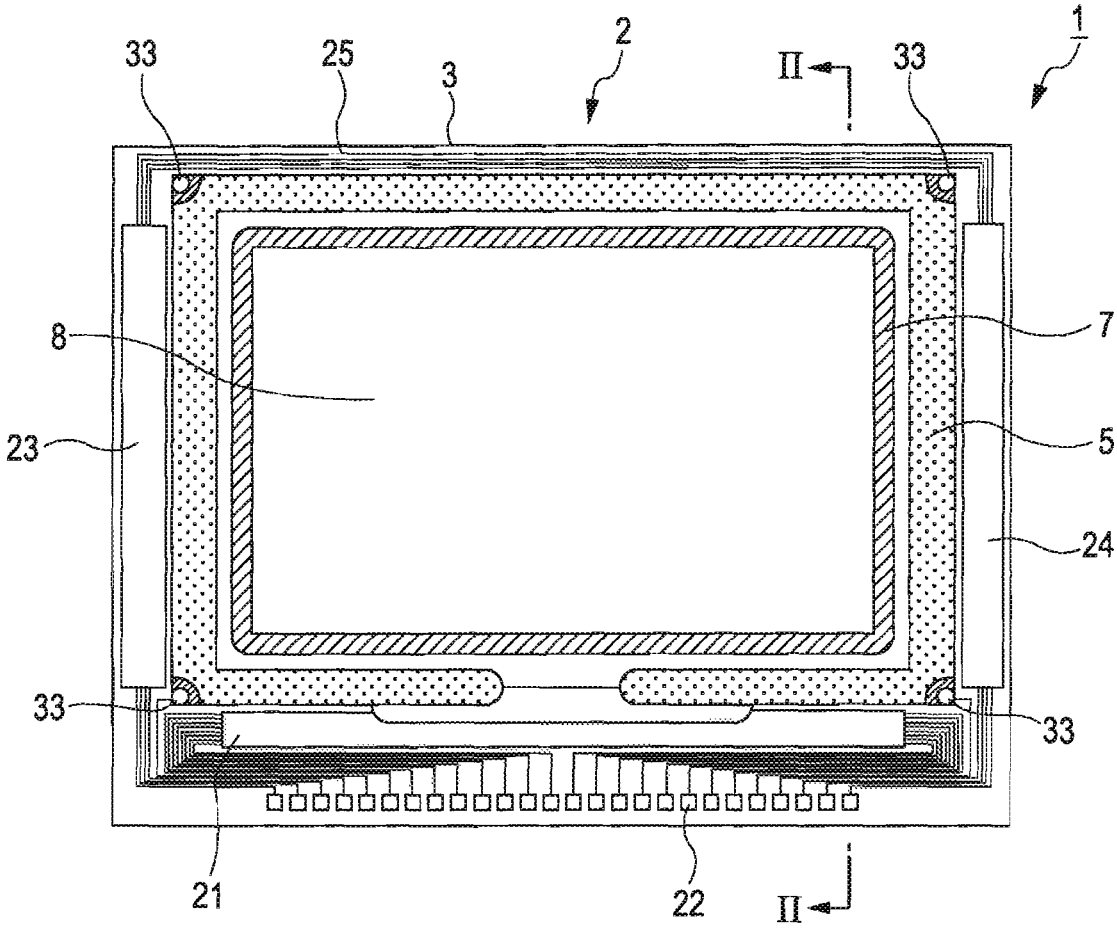
FIG. 1 is a plan view showing a liquid crystal device according to a first embodiment of the invention.
Figure 2:
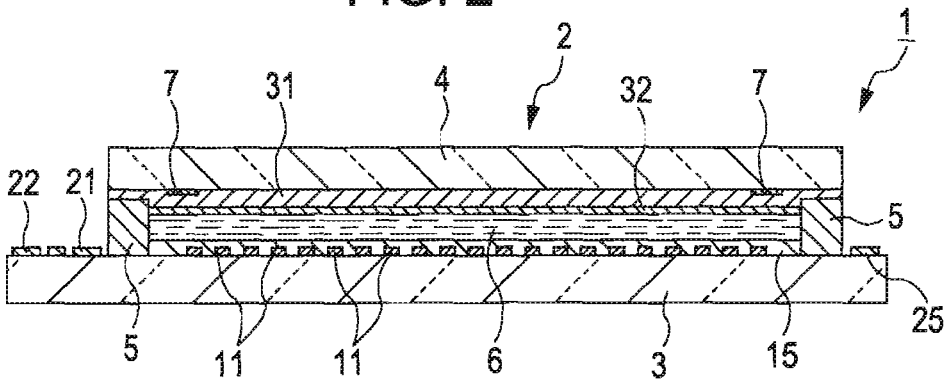
FIG. 2 is a sectional view taken along the line II-II shown in FIG. 1.
Figure 3:
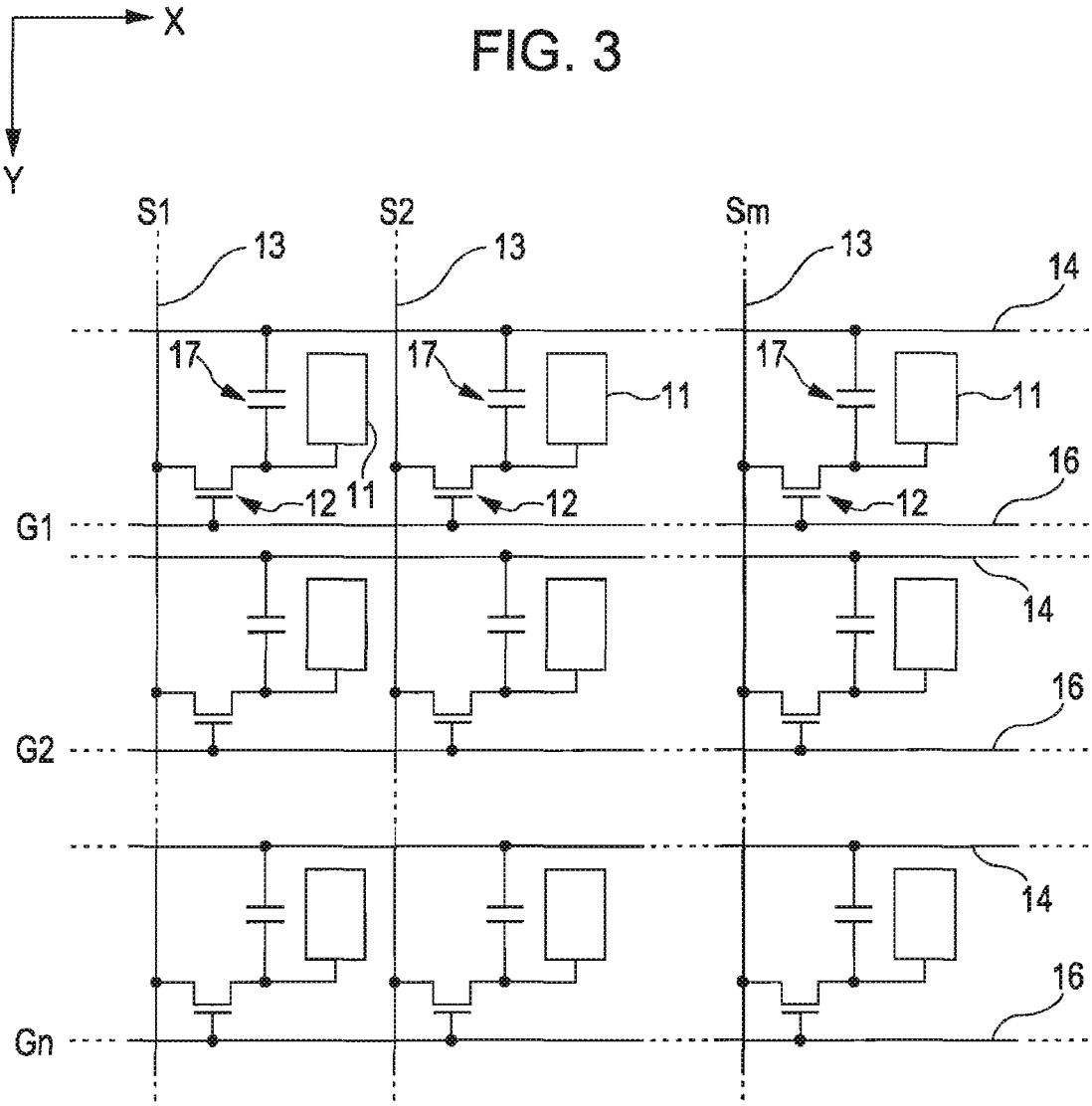
FIG. 3 is an equivalent circuit diagram of the liquid crystal device shown in FIG. 1.
Figure 4:
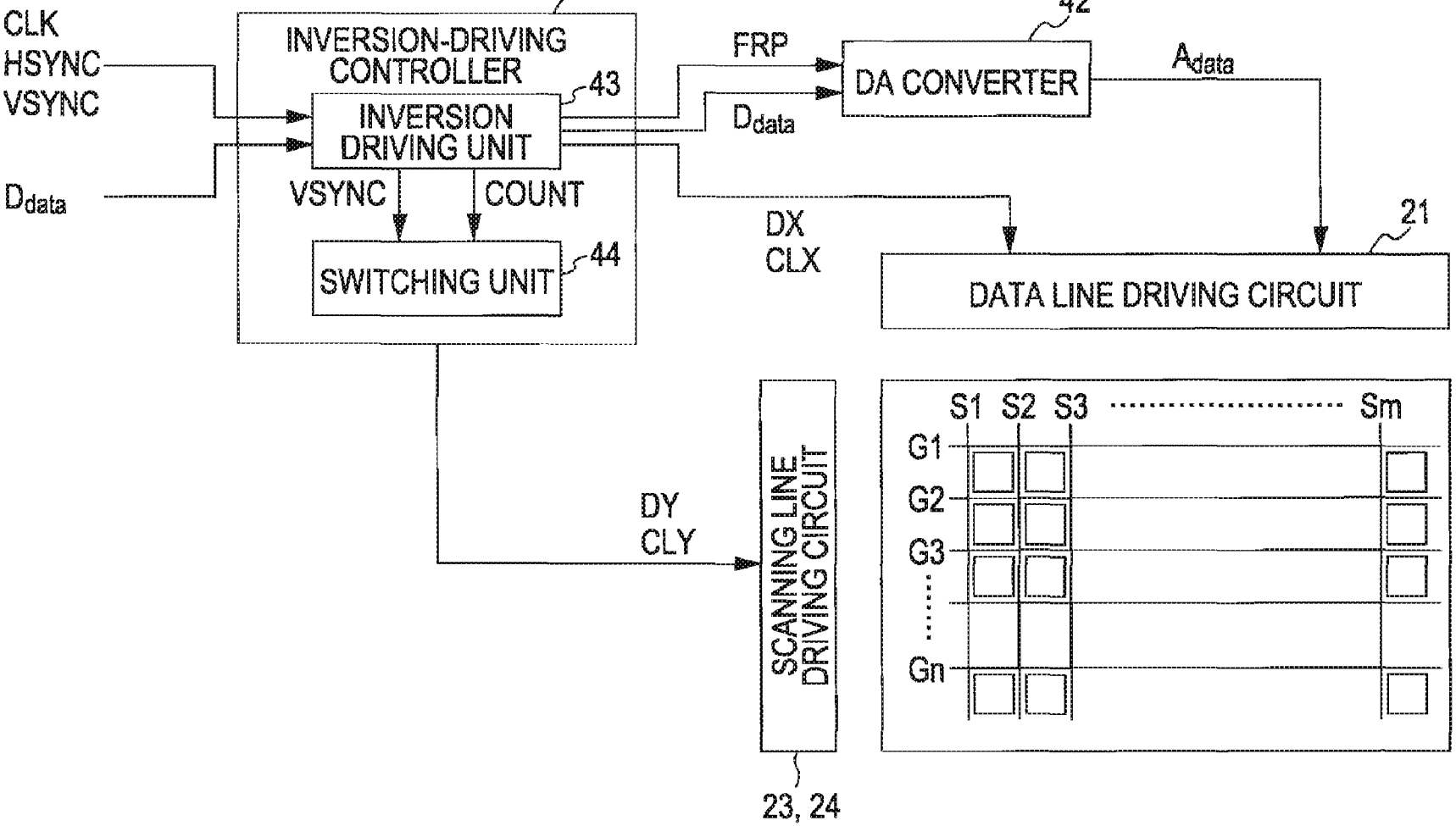
FIG. 4 is a block diagram showing the liquid crystal device shown in FIG. 1.

A liquid crystal device 1 according to a first embodiment of the invention, a method for driving the liquid crystal device, and an electronic apparatus including the liquid crystal device are described with reference to the accompanying drawings. FIG. 1 is a plan view showing the liquid crystal device 1 according to the first embodiment. FIG. 2 is a sectional view taken on line II-II shown in FIG. 1. FIG. 3 is an equivalent circuit diagram showing the liquid crystal panel shown in FIG. 1. FIG. 4 is a block diagram showing the liquid crystal device in FIG. 1. In each drawing used in the following description, in order for each layer and each member to have size capable of recognition on the drawing, the scale is changed for the layer and the member, if needed.

The liquid crystal device 1 according to the first embodiment is a TFT (thin film transistor) active-matrix OCB-mode liquid crystal device in which TFTs are used as pixel switching elements. As shown in FIGS. 1 and 2, the liquid crystal device 1 includes a liquid crystal panel 2, and polarizers (not shown) provided on external surfaces of the liquid crystal panel 2.

As shown in FIGS. 1 and 2, the liquid crystal panel 2 includes a TFT substrate 3, a counter substrate 4 opposing the TFT substrate 3, a sealing material 5 bonding the TFT substrate 3 and the counter substrate 4, and a liquid crystal layer 6 encapsulated in a cell gap formed between the TFT substrate 3 and the counter substrate 4. The liquid crystal layer 6 is supported by the TFT substrate 3 and the counter substrate 4 therebetween. As shown in FIG. 1, the TFT substrate 3 and the counter substrate 4 in the liquid crystal device 1 overlap each other, and a peripheral light-shielding film 7 formed inside the sealing material 5 defines, as an image display area 8, an area inside the sealing region. In FIG. 1, the counter substrate 4 is not shown.

As shown in FIG. 1, the TFT substrate 3 is two-dimensionally rectangular, and is made of, for example, a light-transmissive material such as glass quartz, or plastic. As shown in FIGS. 2 and 3, in an area of the TFT substrate 3 that overlaps the image display area 8, pixel electrodes 11, TFT elements 12, a plurality of data lines 13, and scanning lines 14 are formed. In addition, an alignment film 15 is formed on a surface of the TFT substrate 3.

The pixel electrodes 11 are made of; for example, a light-transmissive conductive material such as ITO (indium tin oxide). The pixel electrodes 11 oppose a counter electrode 31, with the liquid crystal layer 6 provided therebetween. The pixel electrodes 11 and the counter electrode 31 support the liquid crystal layer 6 therebetween.

The TFT elements 12 are formed by, for example, n-type transistors, and are provided correspondingly to intersections between the scanning lines 14 and the data lines 13. Each TFT element 12 has a source electrode connected to one data line 13, a gate electrode connected to one scanning line 14, and a drain electrode connected to one pixel electrode 11. In order to prevent an image signal written in the pixel electrode 11 from leaking, a storage capacitor 17 is connected between the pixel electrode 11 and a capacitive line 16.

As shown in FIG. 3, the data lines 13 are wires made of a metal such as aluminum, and extend in the Y-direction shown in FIG. 3. Similarly to the data lines 13, the scanning lines 14 extend in the X-direction shown in FIG. 3. The data lines 13 and the scanning lines 14 delimit pixels.

In the above description, among the plurality of pixels, series of pixels arranged along the scanning lines 14 are called "rows", while series of pixels arranged along the data lines 13 are called "columns". Specifically, in FIG. 3, the pixels have the 1st, 2nd, . . . and n-th rows in the Y-direction, and the 1 st, 2nd, . . . , and m-th columns in the X-direction. In addition, a direction in which pixels are arranged along the scanning lines 14 are called a "row direction", while a direction in which pixels are arranged along the data lines 13 are called a "column direction".

In a peripheral area on the TFT substrate 3 around the sealing material 5, a data line driving circuit 21 and external mounting terminals 22 are formed along one side of the TFT substrate 3. In the peripheral area on the TFT substrate 3, scanning driving circuits 23 and 24 are formed along two sides abutting on the one side. The data line driving circuit 21, the external mounting terminals 22, and the scanning driving circuits 23 and 2.4 are connected to one another by wires 25.

On the basis of signals supplied from an inversion-driving controller 41 and a DA (digital to analog) converter 42, which are described later, the data line driving circuit 21 can supply the data lines 13 with image signals S1, S2, . . . , and Sm as shown in FIGS. 3 and 4. Image signals written in the data lines 13 by the data line driving circuit 21 may be sequentially supplied in a line sequential manner, and may be supplied for each set of data lines 13, which are adjacent.

On the basis of the signal supplied from the inversion driving unit 43, the scanning driving circuits 23 and 24 can supply the scanning lines 14 with scanning signals G1, G1, . . . , and Gn in pulse form with predetermined timing. The scanning signals supplied to the scanning lines 14 by the scanning driving circuits 23 and 24 are supplied in a line sequential manner.

As shown in FIGS. 1 and 2, the counter substrate 4 is two-dimensionally rectangular similarly to the TFT substrate 3, and is made of a light-transmissive material such as glass, quartz, or plastic. A surface of the counter substrate 4 to the liquid crystal layer 6 has a counter electrode 31 formed thereon.

Similarly to the pixel electrodes 11, the counter electrode 31 is a plane film made of a light-transmissive material such as ITO.

In addition, a surface of the counter substrate 4 has an alignment film 32 formed thereon. A rubbing direction of the alignment film 32 is almost identical to that of the alignment film 15. The counter substrate 4 has, in its corners, inter-substrate conducive materials 33 for establishing electric conduction between the TFT substrate 3 and the counter substrate 4.

As shown in FIG. 4, the liquid crystal device 1 also includes the inversion-driving controller 41 and the DA converter 42.

The inversion-driving controller 41 includes an inversion driving unit 43 having a plurality of inversion driving modes in which relative polarities of voltages applied to the pixels are periodically inverted, and a switching unit 44 for switching the inversion driving modes.

The inversion driving unit 43 has, as two types of inversion driving modes, a gate-line inversion-driving mode and a frame inversion-driving mode. Each inversion driving mode is described later. In the first embodiment, when the liquid crystal device 1 is supplied with power, the gate-line inversion-driving mode is selected as one inversion driving mode. On the basis of one inversion driving mode selected between the two types of inversion driving modes by the switching unit 44, by driving the data line driving circuit 21 and the scanning driving circuits 23 and 24, the inversion driving unit 43 can apply voltages to the source electrodes and gate electrodes of the TFT elements 12 forming the pixels through the data lines 13 and the scanning lines 14.

In addition, on the basis of clock signal CLK, horizontal synchronizing signal HSYNC, and vertical synchronizing signal VSYNC that are supplied from an external circuit (not shown) through the external mounting terminals 22, the inversion driving unit 43 can generate polarity signal FRP, data-line-driving-circuit start signal DX, data-line-driving-circuit clock CLX, scanning-line-driving-circuit start signal DY, and scanning-line-driving-circuit clock CLY. In addition, the inversion driving unit 43 can directly supply digital image signal $D_{data}$ from the external circuit.

The inversion driving unit 43 can supply the DA converter 42 with polarity signal FRP and digital image signal $D_{data}$. The inversion driving unit 43 can also supply the data line driving circuit 21 with data-line-driving-circuit start signal DX and data-line-driving-circuit clock CLX. The inversion driving unit 43 can supply the scanning driving circuits 23 and 24 with scanning-line-driving-circuit start signal DY and scanning-line-driving-circuit clock CLY.

At a time of transition of liquid crystal in the liquid crystal layer 6 from the splay alignment to the bend alignment, the switching unit 44 can perform inversion-driving-mode switching from the gate-line inversion-driving mode, which is selected in initial driving, to a different inversion driving mode, that is, the frame inversion-driving mode.

The DA converter 42 can convert digital image signal $D_{data}$ input from the inversion-driving controller 41 from digital to analog form. In addition, the DA converter 42 can generate analog image signal $A_{data}$ on the basis of polarity signal FRP generated by the inversion-driving controller 41, and can supply analog image signal $A_{data}$ to the data line driving circuit 21.

Method for Driving Liquid Crystal Device

Figure 5:
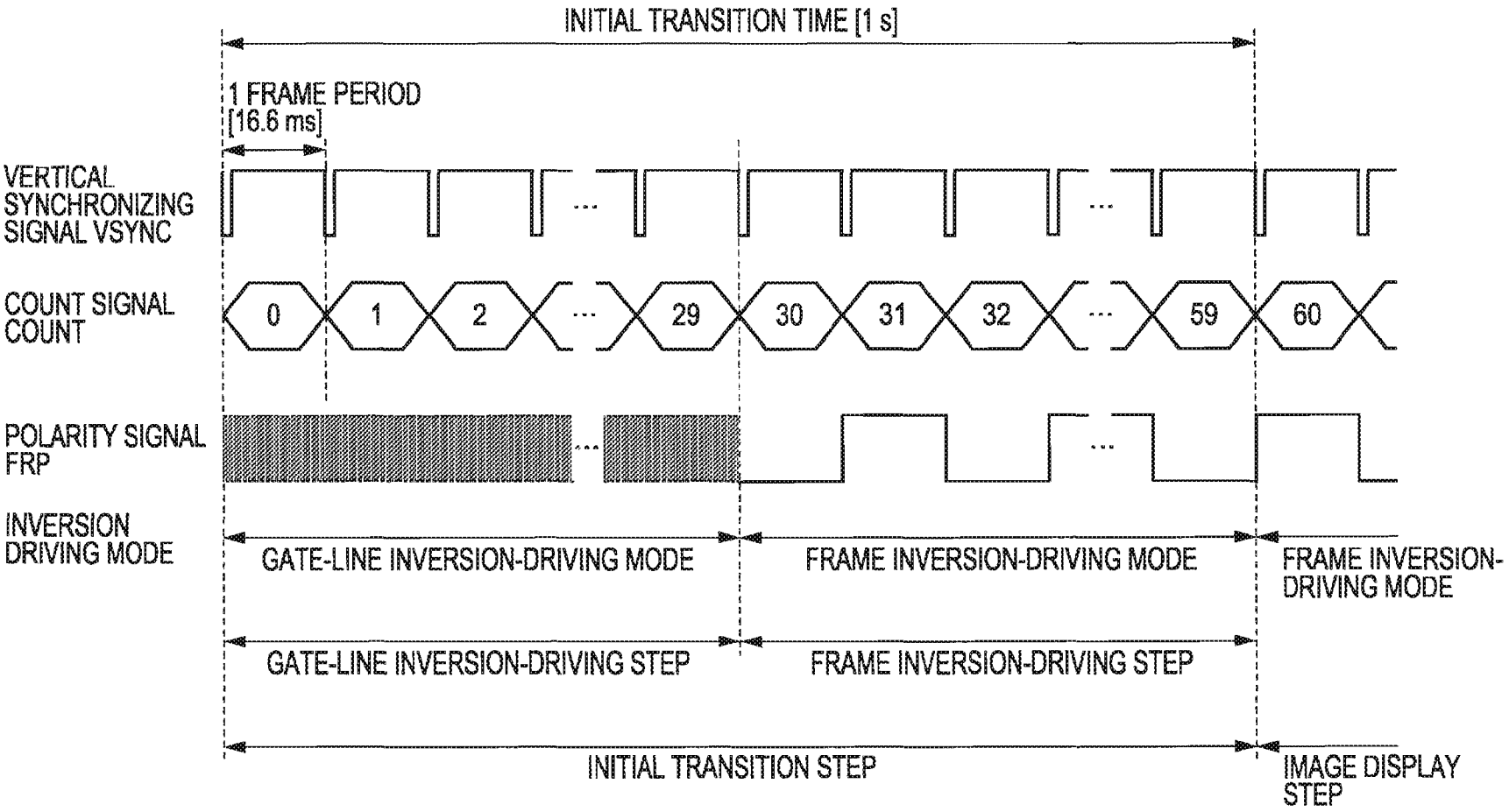
FIG. 5 is a timing chart showing a driving method in the first embodiment.
Figure 6:
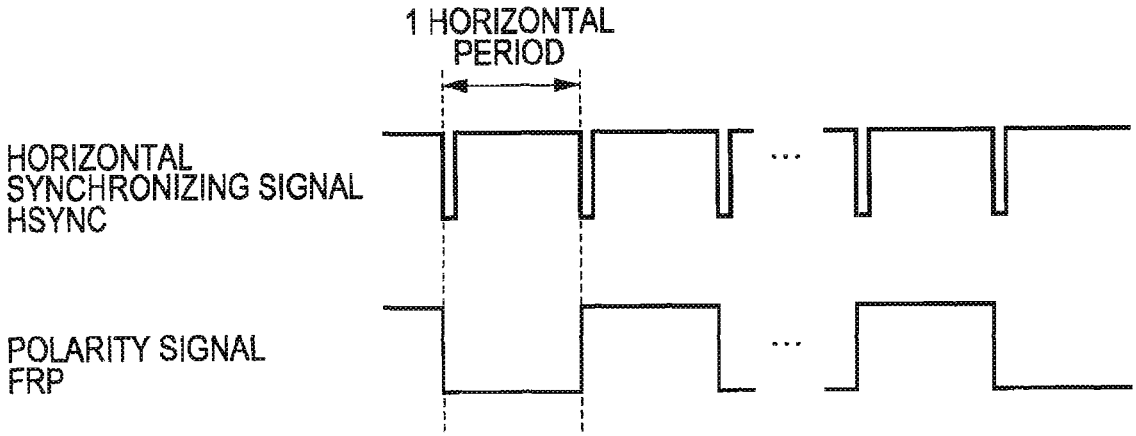
FIG. 6 is a timing chart showing a polarity signal in gate-line inversion driving.
Figure 7:
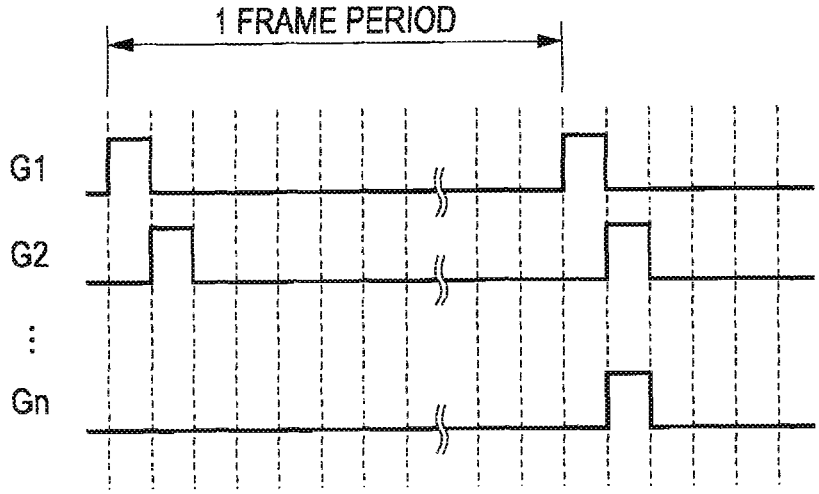
FIG. 7 is a timing chart showing scanning signals.
Figure 8:
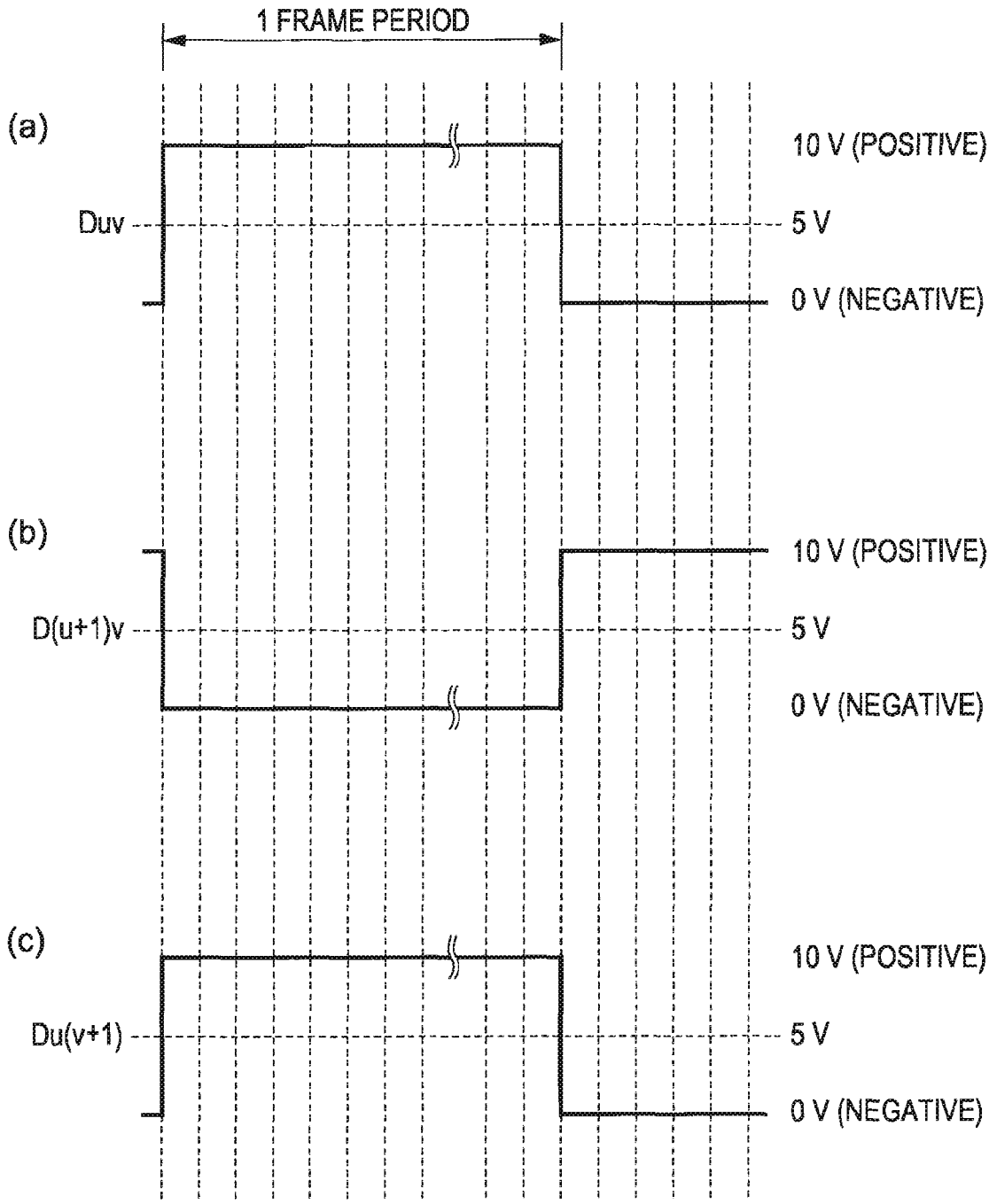
FIG. 8 is a timing chart showing image signals in gate-line inversion driving.
Figure 9:
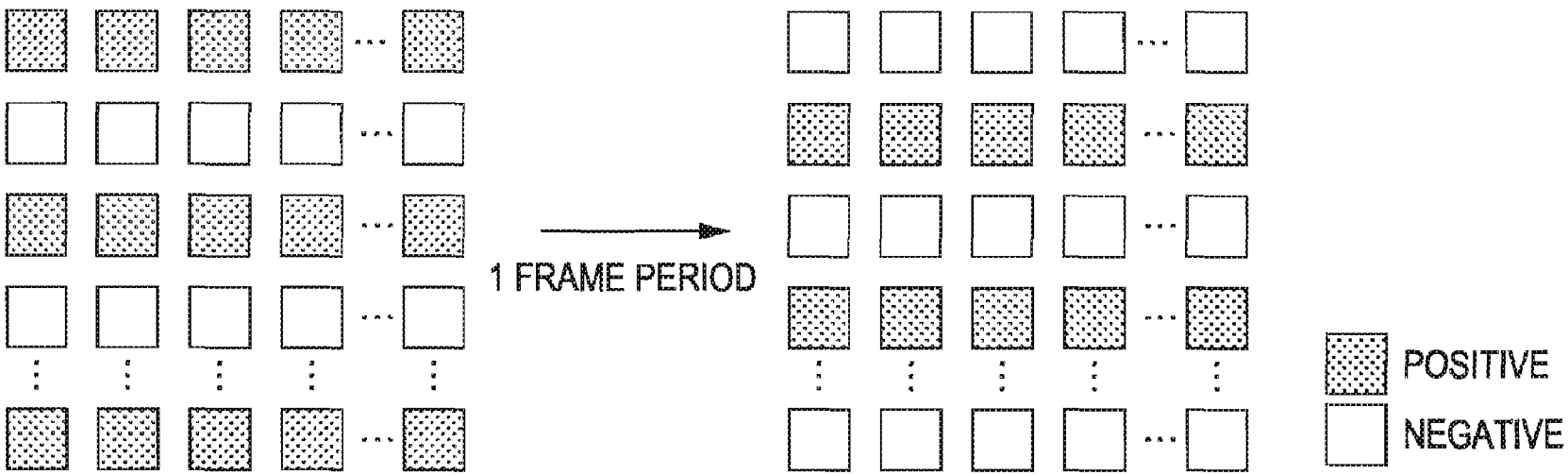
FIG. 9 is an illustration of relative polarities in pixels in gate-line inversion driving.
Figure 10:
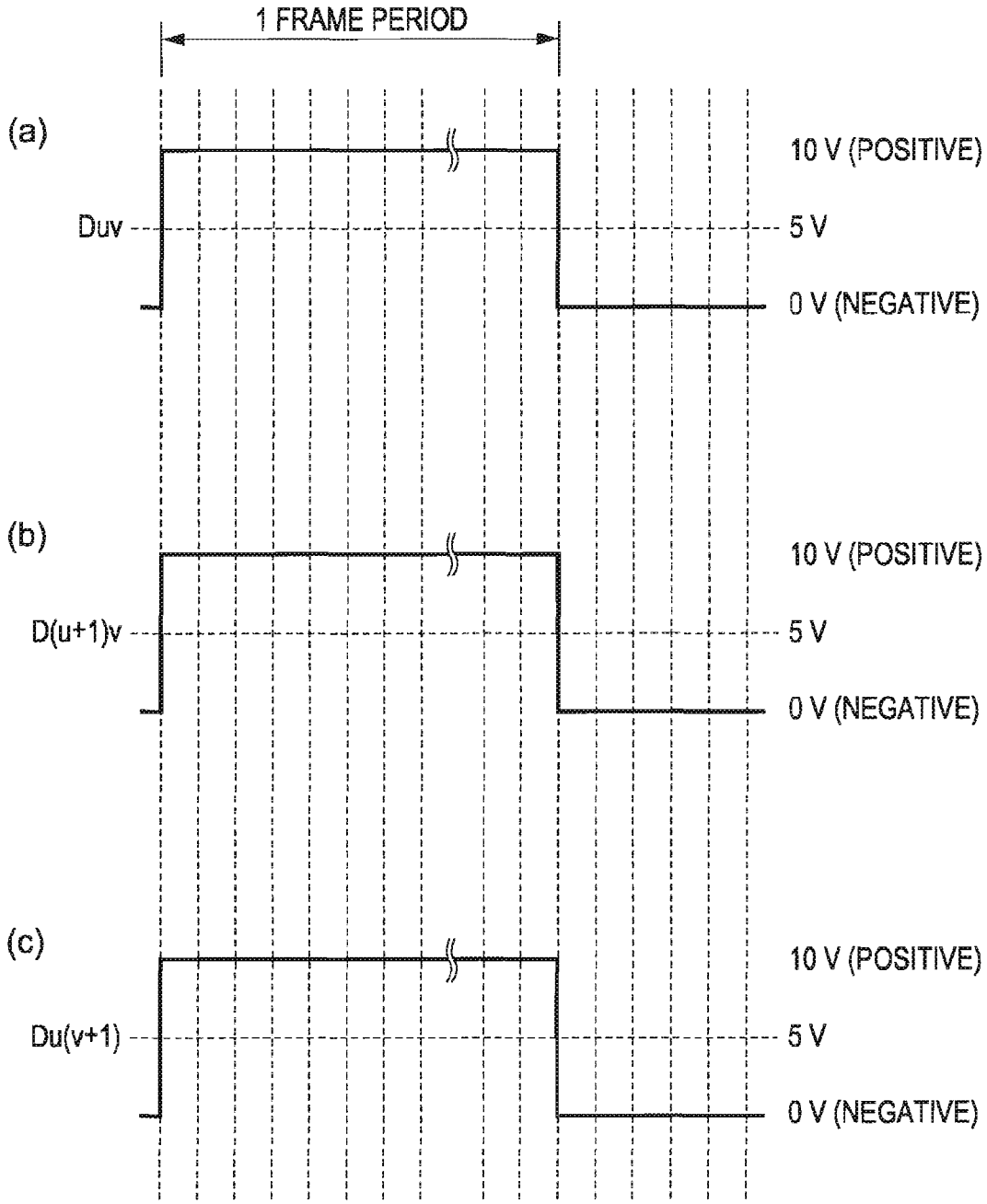
FIG. 10 is a timing chart showing image signals in frame inversion driving.
Figure 11:
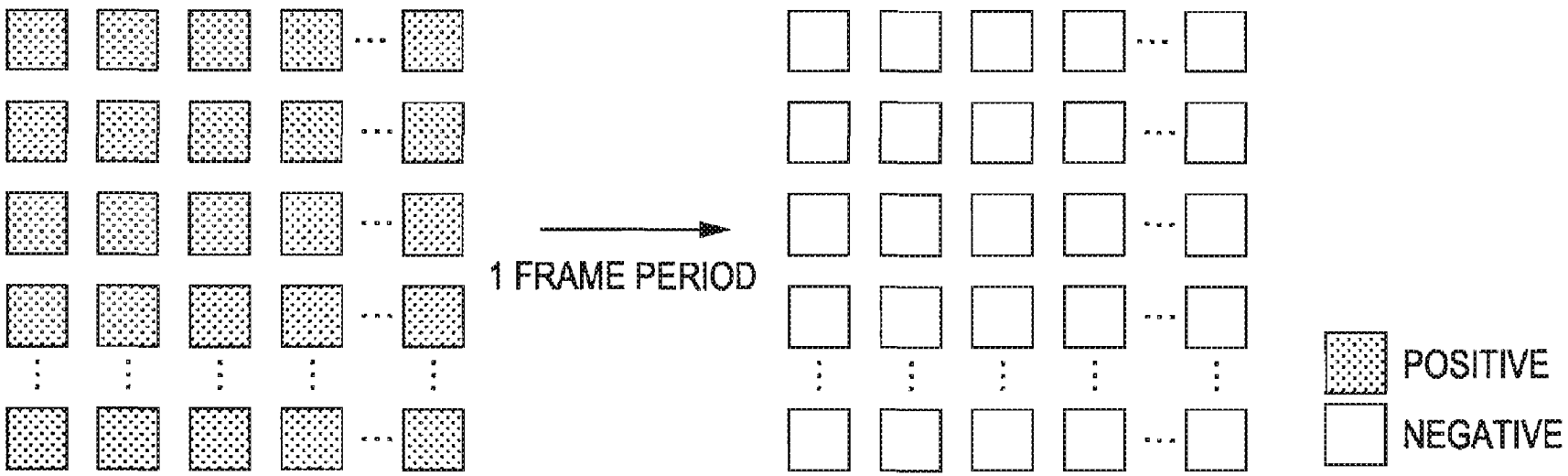
FIG. 11 is an illustration of relative polarities in pixels in frame inversion driving.

A method for driving the liquid crystal device 1 having the above-described configuration is described below. FIG. 5 is a timing chart showing a method for driving the liquid crystal device 1 according to the first embodiment. FIG. 6 is a timing chart of a polarity signal in a gate-line inversion-driving step. FIG. 7 is a scanning signal timing chart. FIG. 8 is a timing chart of an image signal in the gate-line inversion-driving step. FIG. 9 is an illustration of relative polarities of voltages applied to pixels in the gate-line inversion-driving step. FIG. 10 is a timing chart of image signals in a frame inversion-driving step. FIG. 11 is an illustration of relative polarities of voltages applied to pixels in the frame inversion-driving step.

The method for driving the liquid crystal device 1 according to the first embodiment includes an initial transition step and an image display step. The initial transition step is mainly described below, omitting a description of the other steps, since some exemplary embodiments are characterized by the initial transition step. The liquid crystal device 1 has a drive frequency of 60 hertz, and the period of one frame is 1/60 seconds (approximately 16.6 milliseconds). In the liquid crystal device 1, a common potential of the counter electrode 31 is set to 5 volts. Accordingly, if each of voltages of 0 volts, 5 volts, and 10 volts is applied to the pixel electrode 11 on the TFT substrate 3, this state is effectively equivalent to a case in which each of voltages of −5 volts, 0 volts, and +5 volts is applied between the TFT substrate 3 and the pixel electrode 11. It is preferable that the voltage applied between the counter electrode 31 and the pixel electrode 11 in the initial transition step be approximately a maximum voltage applied in the image display step. Because a higher voltage is preferable for performing a fast transition from the splay alignment to the bend alignment. However, an extremely high voltage causes a large load on each TFT element. In other words, in the first embodiment, approximately the maximum voltage used for normal image display is sufficiently effective in accelerating the initial transition. Therefore, in the first embodiment, the absolute value of the voltage applied between the counter electrode 31 and the pixel electrode 11 in the initial transition step is set to 5 volts.

The initial transition step includes a gate-line inversion-driving mode and a frame inversion-driving mode.

First, when the liquid crystal device 1 is driven by supplying power thereto, the liquid crystal device 1 receives clock signal CLK, horizontal synchronizing signal HSYNC, vertical synchronizing signal VSYNC, and digital image signal $D_{data}$ from the external circuit through the external mounting terminals 22. At this time, a liquid-crystal alignment state of the liquid crystal layer 6 is in the splay alignment.

Next, a gate-line inversion-driving step is performed. In the gate-line inversion-driving step, voltages are applied to a plurality of pixels on the basis of the gate-line inversion-driving mode in the following manner.

By receiving clock signal CLK, horizontal synchronizing signal HSYNC, vertical synchronizing signal VSYNC, and digital image signal $D_{data}$ from the external circuit, the inversion driving unit 43 generates data-line-driving-circuit start signal DX, data-line-driving-circuit clock CLX, scanning-line-driving-circuit start signal DY, and scanning-line-driving-circuit clock CLY.

Since the gate-line inversion-driving mode is selected as the inversion driving mode by the inversion driving unit 43, as shown in FIG. 6, generated polarity signal FRP performs toggling in which its polarity is inverted whenever horizontal synchronizing signal HSYNC is received. Therefore, polarity signal FRP generated in the gate-line inversion-driving step is identical in polarity between a set of pixels forming an arbitrary row among the plurality of pixels, and is reverse in polarity in sets of pixels forming different rows adjacent to the arbitrary row.

The inversion driving unit 43 supplies the DA converter 42 with digital image signal $D_{data}$ and generated polarity signal FRP. The inversion driving unit 43 supplies the data line driving circuit 21 with data-line-driving-circuit start signal DX and data-line-driving-circuit clock CLX. The inversion driving unit 43 supplies each of the scanning driving circuits 23 and 24 with scanning-line-driving-circuit start signal DY and scanning-line-driving-circuit clock CLY.

The DA converter 42 generates analog image signal $A_{data}$ from digital image signal $D_{data}$ and polarity signal FRP, and supplies generated analog image signal $A_{data}$ to the data line driving circuit 21.

After that, the scanning driving circuits 23 and 24 supply the scanning lines 14 with scanning signals G1, G2, . . . , and Gn on the basis of supplied scanning-line-driving-circuit start signal DY and scanning-line-driving-circuit clock CLY.

In addition, the data line driving circuit 21 supplies the data lines 13 with image signals S1, S2, . . . , and Sm on the basis of supplied analog image signal $A_{data}$, data line-driving-circuit start signal DX, and data-line-driving-circuit clock CLX.

Synchronizing with horizontal synchronizing signal HSYNC, the polarity of polarity signal FRP supplied to the DA converter 42 is inverted. Thus, relative polarities of the voltages of image signals S1, S2, . . . , and Sm are identical in polarity in a set of pixels forming an arbitrary row among the plurality of pixels, and are reverse in polarity in sets of pixels forming different rows adjacent in the column direction to the arbitrary row. In other words, as shown in portion (a) of FIG. 8, when the polarity of the voltage of an image signal supplied to pixel Duv among the plurality of pixels is inverted for each frame period, as shown in portion (b) of FIG. 8, the polarity of the voltage of an image signal supplied to pixel D(u+1)v which is adjacent to pixel Duv in the column direction is inverted for each frame period. In addition, the polarity of the voltage of an image signal supplied to pixel Du(v+1) which is adjacent to pixel Duv in the row direction is inverted for each frame period. In portions (a) to (c) of FIG. 8, when the voltage of each image signal supplied to each pixel is equivalently +5 volts, the voltage of the image signal is regarded as positive, while, when the voltage of the image signal is −5 volts, the voltage of the image signal is regarded as negative. In addition, in portions (a) to (c) of FIG. 8, actually, there is a slight delay in timing that the voltage is supplied to each pixel. However, the delay is not shown since it is sufficiently small for each frame period.

Therefore, as shown in FIG. 9, regarding all the plurality of pixels, for each row, the polarity of a voltage applied to pixels forming the row is opposite. After one frame period passes, the polarity of the voltage applied to the pixels is inverted.

In the above-described manner, the gate-line inversion-driving mode is performed, that is, voltages having relatively identical polarities are applied to a set of pixels forming an arbitrary row among the plurality of pixels, and voltages having relatively opposite polarities are applied to sets of pixels forming two rows applied to the arbitrary row.

When, as described above, a plurality of pixels are driven on the basis of the gate-line inversion-driving mode, two adjacent pixels in the column direction have a large potential difference since voltages having opposite polarities are applied to two adjacent rows. Accordingly, a strong horizontal electric field is generated between adjacent pixels in the column direction, so that liquid crystal is in a state in which disclination can easily occur. This easily generates a transition nucleus in which its alignment state has changed from the splay alignment to the bend alignment.

In the gate-line inversion-driving mode, two adjacent pixels in the row direction have a small potential difference since voltages having identical polarities are applied to pixels forming the same row. Accordingly, the alignment state of the generated transition nucleus can easily be conducted along the row direction, with the generated transition nucleus as a base. In other words, the generated transition nucleus can easily grow along the row direction. As described above, in the gate-line inversion-driving mode, two adjacent pixels in the column direction have a large potential difference. Thus, it is difficult for the alignment state to be conducted in the column direction, with the generated transition nucleus as a base.

In addition, the switching unit 44 generates count signal COUNT that is counted up whenever vertical synchronizing signal VSYNC is generated. When the switching unit 44 counts 30 vertical synchronizing signals VSYNC, that is, when 30 frame periods (0.5 seconds) pass, the switching unit 44 switches the inversion driving mode selected by the inversion driving unit 43 from the gate-line inversion-driving mode to the frame inversion-driving mode. Switching of the inversion driving mode is performed in this manner. During the 30 frame periods (0.5 seconds) until the inversion driving mode is switched by the switching unit 44, sufficient transition nuclei are generated in the plurality of pixels.

Next, the frame inversion-driving step is performed. In the frame inversion-driving step, voltages are applied to the plurality of pixels on the basis of the frame inversion-driving mode in the following manner.

At this time, the frame inversion-driving mode is selected as the inversion driving mode by the inversion driving unit 43, as shown in FIG. 5, polarity signal FRP performs toggling in which the polarity of polarity signal FRP is inverted whenever vertical synchronizing signal VSYNC is input.

On the basis of scanning-line-driving-circuit supplied start signal DY and scanning-line-driving-circuit clock CLY, the scanning driving circuits 23 and 24 supply the scanning lines 14 with scanning signals G1, G2 . . . , and Gn as shown in FIG. 7 similarly to the gate-line inversion-driving step.

The data line driving circuit 21 supplies the data lines 13 with image signals S1, S2, . . . , and Sm on the basis of supplied analog image signal $A_{data}$, data-line-driving-circuit start signal DX, and data-line-driving-circuit clock CLX.

Relative polarities of the voltages of image signals S1, S2, . . . , and Sm are identical for all the plurality of pixels because the polarity of polarity signal FRP supplied to the DA converter 42 is inverted synchronizing with vertical synchronizing signal VSYNC. In other words, when the polarity of the voltage of an image signal supplied to pixel Duv among the plurality of pixels is inverted for each frame period, as shown in portion (a) of FIG. 10, the polarity of the voltage of an image signal supplied to pixel D(u+1) that is adjacent to pixel Duv in the column direction is inverted for each frame period, as shown in portion (b) of FIG. 10. Also the polarity of the voltage of an image signal supplied to pixel Du(v+1) that is adjacent to pixel Duv in the row direction is inverted for each frame period, as shown in portion (e) of FIG. 10. In portions (a) to (c) of FIG. 10, actually, there is a slight delay in timing that the voltage is supplied to each pixel. However, the delay is not shown since it is sufficiently small for each frame period.

Therefore, as shown in FIG. 11, the polarities of the voltages applied to all the pixels are identical. After one frame period passes, the polarities of the voltages applied to the pixels are inverted.

In the above manner, the frame inversion-driving mode is performed, in which voltages having relatively identical polarities are applied to all the plurality of pixels.

When voltages are applied to the plurality of pixels on the basis of the frame inversion-driving mode, there is a small potential difference between pixels since the voltages are applied to all the pixels in the same polarity. This rapidly conducts the alignment state of the transition nucleus generated in the gate-line inversion-driving step in the row direction and the column direction. Although the magnitude of the generated horizontal electric field is weaker than that generated in the gate-line inversion-driving mode, transition nuclei are generated together with conduction of the alignment state of the transition nucleus.

In addition, when the switching unit 44 counts 60 vertical synchronizing signals VSYNC, that is, when 60 frame periods (one second) pass from the start of the initial transition step, the initial transition step finishes. During the 30 frame periods (0.5 seconds) after the inversion driving mode is switched to the frame inversion-driving mode, the alignment state of the transition nucleus generated in the gate-line inversion-driving step is conducted to all the pixels. As described above, a transition of liquid-crystal alignment states of all the pixels from the splay alignment to the bend alignment is performed.

After that, in an image display step, an image is displayed on the image display area 83 with the frame inversion-driving mode selected. In this state, a transition of the liquid-crystal alignment states of all the pixels can be performed, thus reducing a time from supply of power to the start of the image display step.

In the case of performing an initial transition of liquid crystal by continuously performing the gate-line inversion-driving step without switching to the frame inversion-driving step, even if generated transition nuclei increase, a time of ten and several seconds is needed for performing a transition of liquid-crystal alignment states of all the pixels. In other words, as described above, in the gate-line inversion-driving mode, transition nuclei can easily be generated due to a large horizontal electric field. Accordingly, even if switching to the frame inversion-driving step is not performed, generated transition nuclei increase and the alignment state of each transition nucleus can easily be conducted in the row direction. However, the transition of liquid-crystal alignment states of all the pixels requires a considerable time since it is difficult for the alignment state of the transition nucleus to be conducted in the column direction.

Electronic Apparatus

Figure 12:
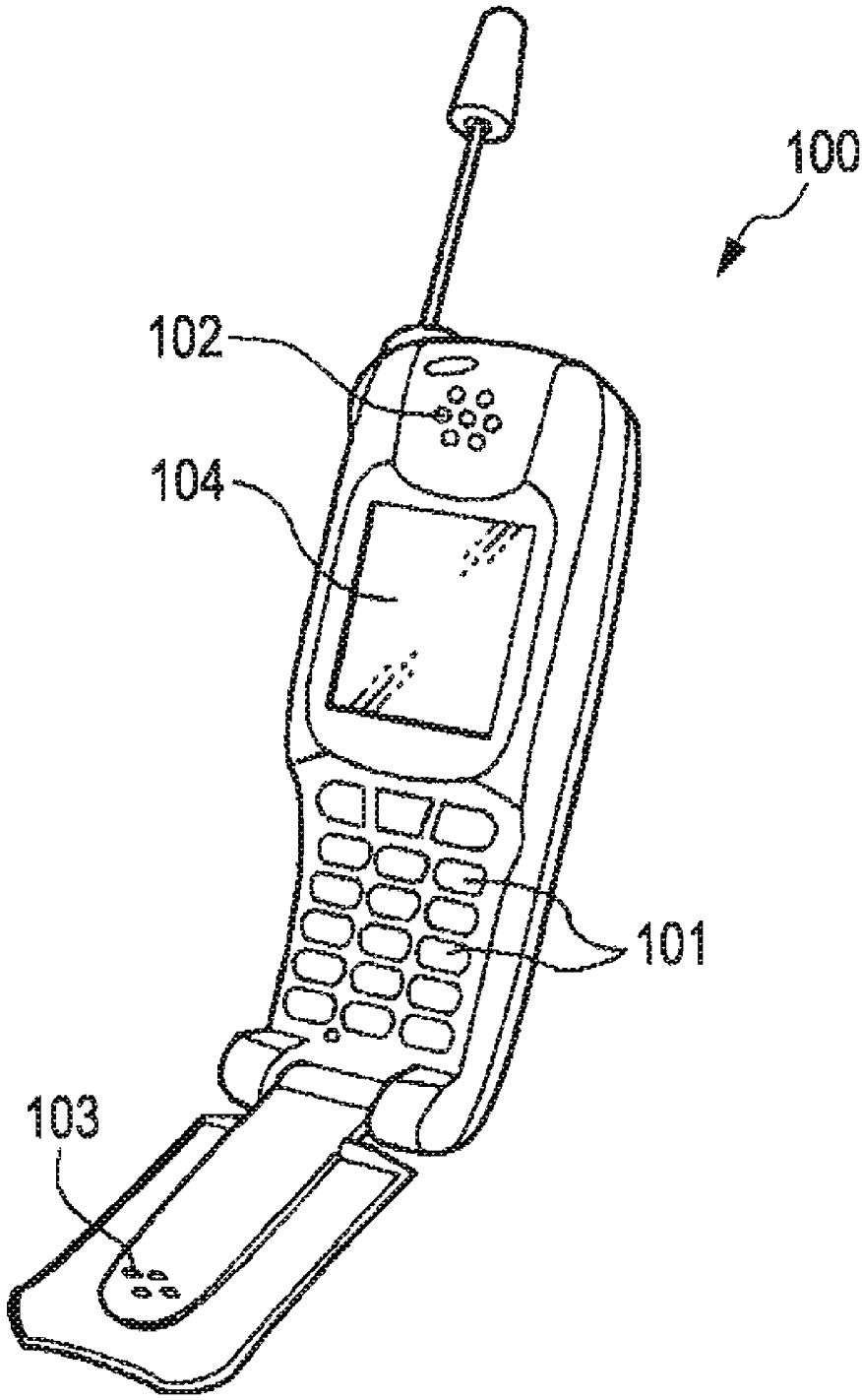
FIG. 12 is a perspective view showing an electronic apparatus according to the first embodiment.
Figure 13:
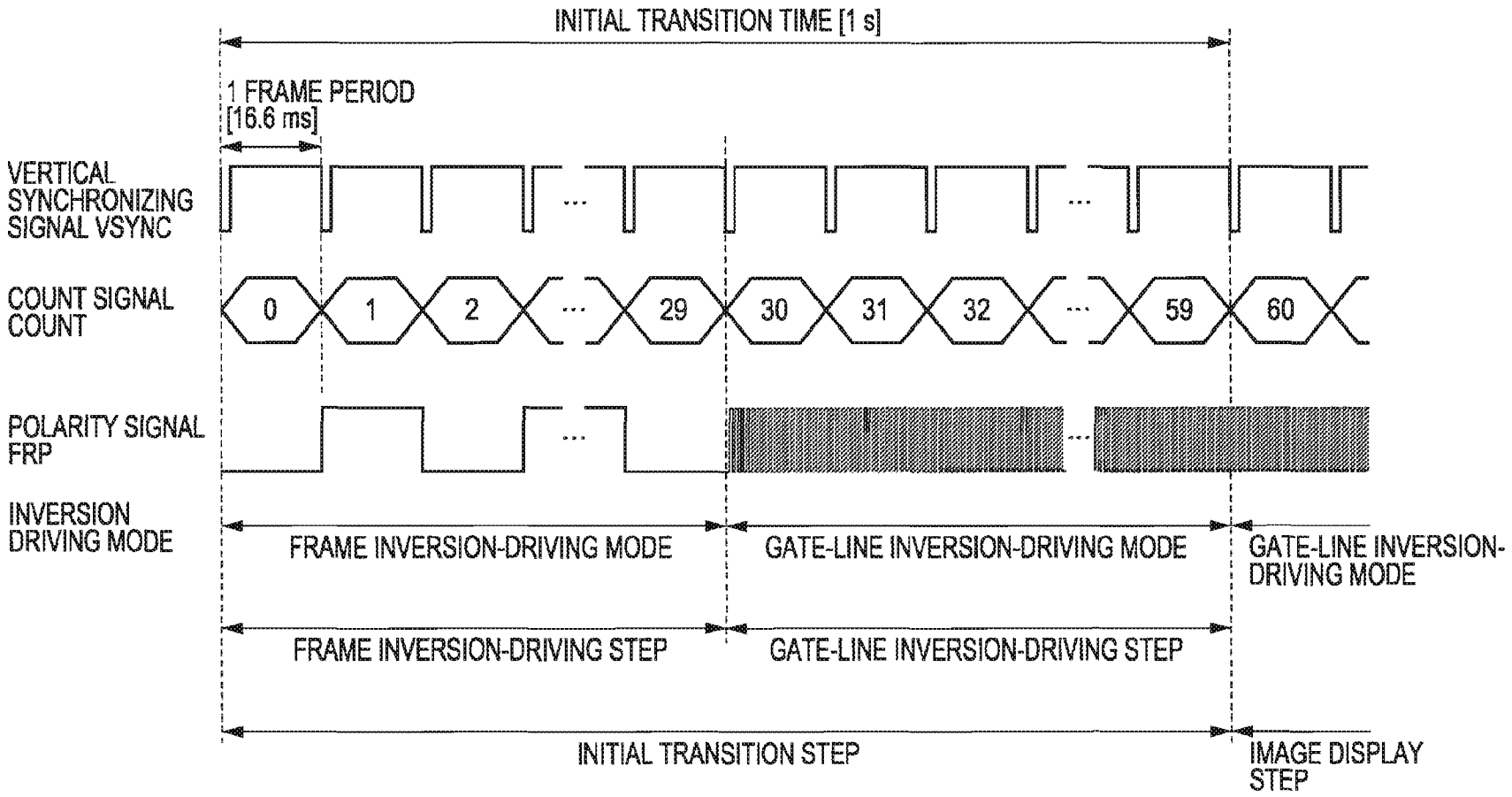
FIG. 13 is a timing chart showing a driving method in a second embodiment of the invention.

The liquid crystal device 1 having the above-described configuration is provided in, for example, the cellular phone 100 (electronic apparatus) shown in FIG. 12. FIG. 12 is a perspective view of the cellular phone 100. The cellular phone 100 includes a plurality of operation buttons 101, an earpiece 102, a mouthpiece 103, and a display unit 104 including the liquid crystal device 1 according to the first embodiment.

According to the liquid crystal device 1 according to the first embodiment, the method for driving the liquid crystal device 1, and the cellular phone 100, When voltages are applied on the basis of the gate-line inversion-driving mode, the gate-line inversion-driving mode is switched to the frame inversion-driving mode before the voltages are applied, whereby the liquid crystal alignment is fluctuated, thus performing a fast initial transition. In addition, compared with a case in which the voltages are applied to the pixels on the basis of one inversion driving mode, an initial transition time can be reduced without using additional liquid-crystal-device members. Furthermore, it is not necessary to increase the applied voltages. Thus, the load on the liquid crystal device 1 is small, so that the reliability of the liquid crystal device 1 can be maintained.

In the first embodiment, a combination of the gate-line inversion-driving mode and the frame inversion-driving mode is used, and, in the gate-line inversion-driving mode, the polarities of the voltages of image signals supplied are changed for each column, while, in the frame inversion-driving mode, the polarities of the voltages of image signals supplied to all the pixels are changed. Thus, there is a small load on the liquid crystal device 1 compared with the case of inverting the polarities of the voltages of the image signals for each pixel.

Second Embodiment

Next, a liquid crystal device according to a second embodiment of the invention, a method for driving the liquid crystal device, and an electronic apparatus including the liquid crystal device are described below. In the second embodiment, the liquid-crystal-device driving method differs from that in the first embodiment. Accordingly, differences are mainly described, and the components described in the first embodiment are not described since they are denoted by identical reference numerals.

In the liquid-crystal-device driving method according to the second embodiment, an initial transition step includes a frame inversion-driving step and a gate-line inversion-driving step.

In the frame inversion-driving step, voltages are applied to pixels on the basis of the frame inversion-driving mode. When the switching unit 44 counts 30 vertical synchronizing signals VSYNC, that is, when 30 frame periods (0.5 seconds) pass, the switching unit 44 switches the inversion driving mode selected by the inversion driving unit 43 from the frame inversion-driving mode to the gate-line inversion-driving mode. During the 30 frame periods (0.5 seconds) until the inversion driving mode is switched by the switching unit 44, transition nuclei are generated in a plurality of pixels. At this time, compared with a case in which a strong horizontal electric field between two adjacent pixels is used as in line inversion driving, it is difficult for transition nuclei to be generated in frame inversion driving. However, the plurality of pixels are in a state close to a transition nucleus state.

In the gate-line inversion-driving, step, which follows the frame inversion-driving step, voltages are applied to the pixels on the basis of the gate-line inversion-driving mode. When the switching unit 44 counts 60 vertical synchronizing signals VSYNC, that is, when 60 frame periods (one second) from the start of the initial transition step, the initial transition step finishes. During the 30 frame periods (0.5 seconds) after the inversion driving mode is switched to the gate-line inversion-driving mode by the switching unit 44, a generated transition-nucleus alignment state is conducted to all the pixels.

After that, an image display step is performed, with the gate-line inversion-driving mode selected.

As described above, the liquid crystal display according to the second embodiment, the liquid-crystal-device driving method, and the electronic apparatus produce operation and advantages similar to those in the above-described first embodiment.

Third Embodiment

Next, a liquid crystal display according to a third embodiment of the invention, a method for driving the liquid crystal device, and an electronic apparatus including the liquid crystal device are described below. In the third embodiment, the liquid-crystal-device driving method differs from that in the first embodiment. Accordingly, difference are mainly described, and the components described in the first embodiment are not described since they are denoted by identical reference numerals.

In the liquid crystal device according to the third embodiment, the inversion driving unit 43 includes a source-line inversion-driving mode and a gate-line inversion-driving mode as two types of inversion modes.

On the basis of clock signal CLK, horizontal synchronizing signal HSYNC, vertical synchronizing signal VSYNC supplied from the external circuit through the external mounting terminals 22, the inversion driving unit 43 can generate first and second polarity signals FRP1 and FRP2, data-line-driving-circuit start signal DX, data-line-driving-circuit clock CLX, scanning-line-driving-circuit start signal DY, and scanning-line-driving-circuit clock CLY.

In addition, the DA converter 42 can convert digital image signal $D_{data}$ input from the inversion-driving controller 41 from digital to analog form. The DA converter 42 can also generate analog image signals $A_{data}$ on the basis of first and second polarity signals FRP1 and FRP2 generated by the inversion-driving controller 41. The DA converter 42 can alternately input, to the data lines 13, analog image signal $A_{data}$ generated on the basis of first polarity signal FRP1 and analog image signal $A_{data}$ generated on the basis of second polarity signal FRP2. In other words, analog image signal $A_{data}$ generated on the basis of first polarity signal FRP1 is input to one of two adjacent data lines 13, while analog image signal $A_{data}$ generated on the basis of second polarity signal FRP2 is input to the other data line 13.

Figure 14:
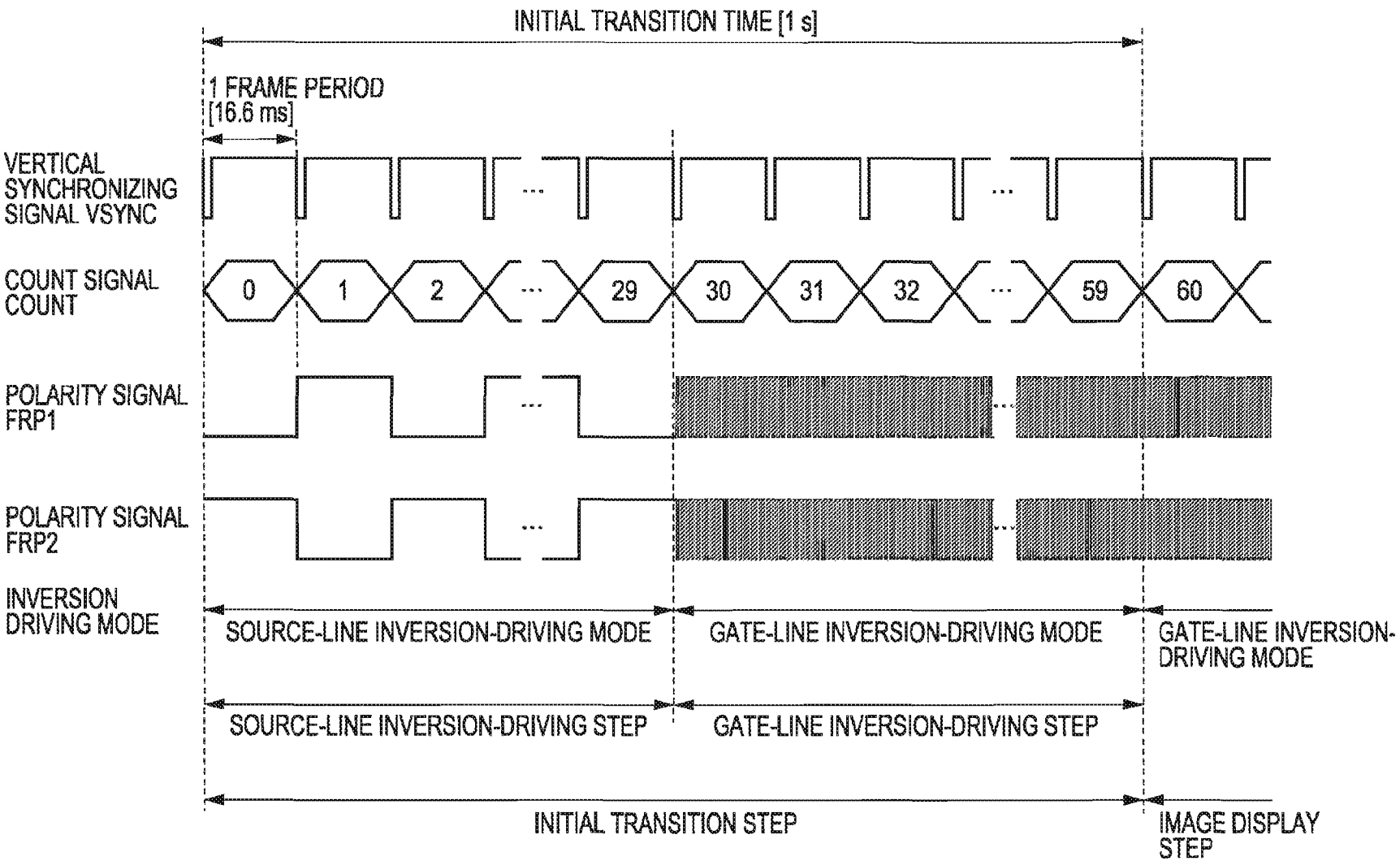
FIG. 14 is a timing chart showing a driving method in a third embodiment of the invention.

Next, the liquid-crystal-device driving method is described below. As shown in FIG. 14, an initial transition step in the third embodiment includes a source-line inversion-driving step and a gate-line inversion-driving step.

In the source-line inversion-driving step, voltages are applied to the pixels on the basis of the source-line inversion-driving step.

As shown in FIG. 14, first and second polarity signals FRP1 and FRP2 generated in the source-line inversion-driving step perform toggling operations in each of which the signal polarity is inverted whenever vertical synchronizing signal VSYNC is input. In addition, first and second polarity signals FRP1 and FRP2 are opposite in polarity. First and second polarity signals FRP1 and FRP2 alternately correspond to the data lines 13. Specifically, first polarity signal FRP1 corresponds to one of two adjacent data lines 13, while second polarity signal FRP2 corresponds to the other data line 13. Accordingly, first and second polarity signals FRP1 and FRP2 generated on the basis of the source-line inversion-driving step are identical in polarity in a set of pixels forming an arbitrary column among the plurality of pixels, and are opposite in polarity in sets of pixels forming different columns adjacent to the arbitrary column.

The scanning driving circuits 23 and 24 supply the scanning lines 14 with scanning signals G1, G2, . . . , and Gn on the basis of supplied scanning-line-driving-circuit start signal DY and scanning-line-driving-circuit clock CLY.

The data line driving circuit 21 supply the data lines 13 with image signals S1, S2, . . . , and Sm on the basis of supplied analog image signal $A_{data}$, data-line-driving-circuit start signal DX, and data-line-driving-circuit clock CLX.

Figure 16:
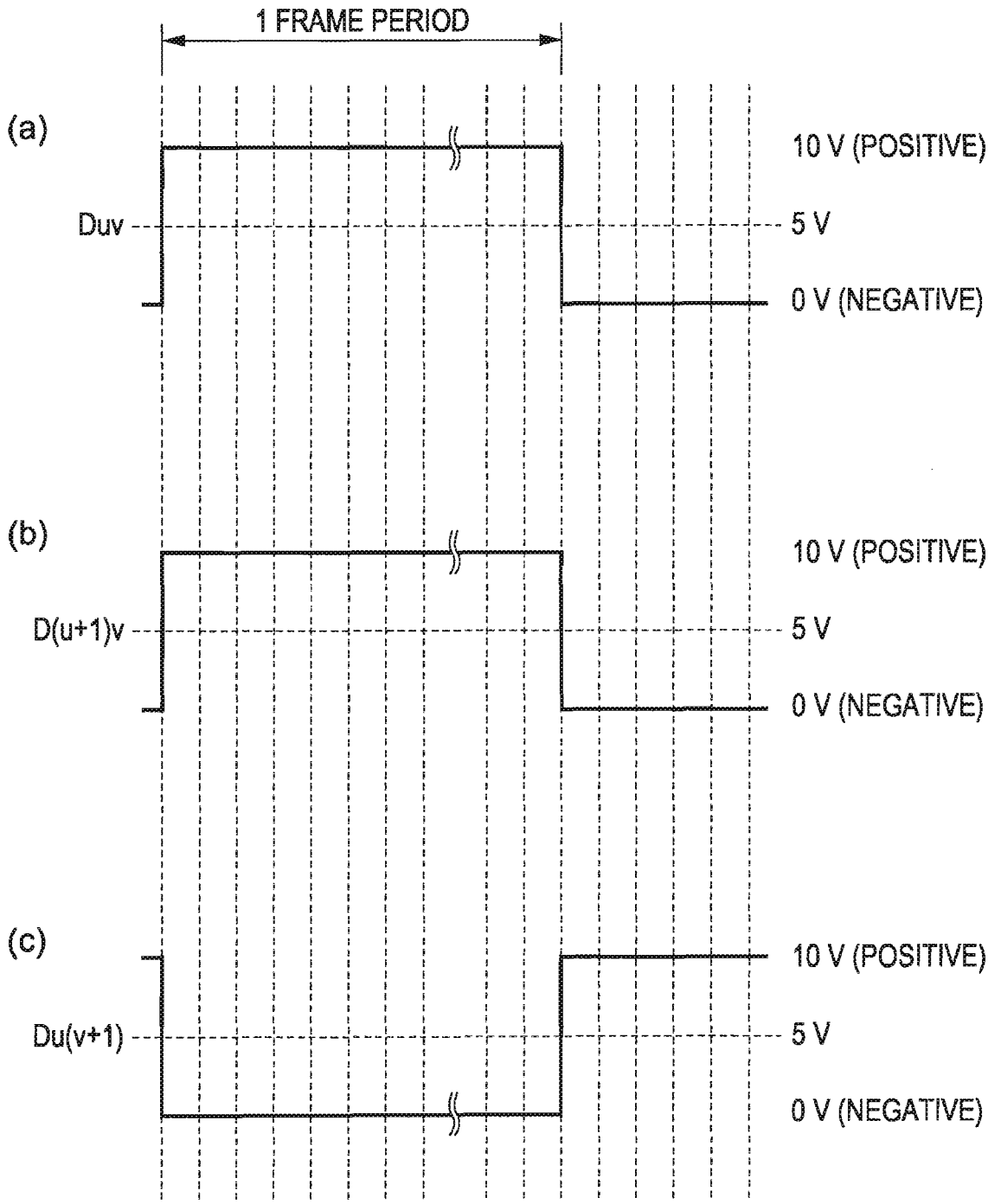
FIG. 16 is a timing chart showing image signals in source-line inversion driving.

First and second polarity signals FRP1 and FRP2 supplied to the DA converter 42 allow relative polarities of image signals S1, S2, . . . , and Sm to be identical in a set of pixels forming an arbitrary row among the plurality of pixels, and are opposite in polarity in sets of pixels forming adjacent columns in the row direction. In other words, when, as shown in portion (a) of FIG. 16, the polarity of the voltage of an image signal supplied to pixel Duv among the plurality of pixels is inverted for each horizontal period, as shown in portion (b) of FIG. 16, the polarity of the voltage of an image signal supplied to pixel D(u+1)v adjacent to pixel Duv in the column direction is inverted for each frame period. As shown in portion (c) of FIG. 16, the polarity of the voltage of an image signal supplied to pixel Du(v+1) adjacent to pixel Dux in the row direction is inverted for each frame period. In portions (a) to (c) of FIG. 16, actually, there is a slight delay in timing that the voltage is supplied to each pixel. However, the delay is not shown since it is sufficiently small for each frame period.

Figure 17:
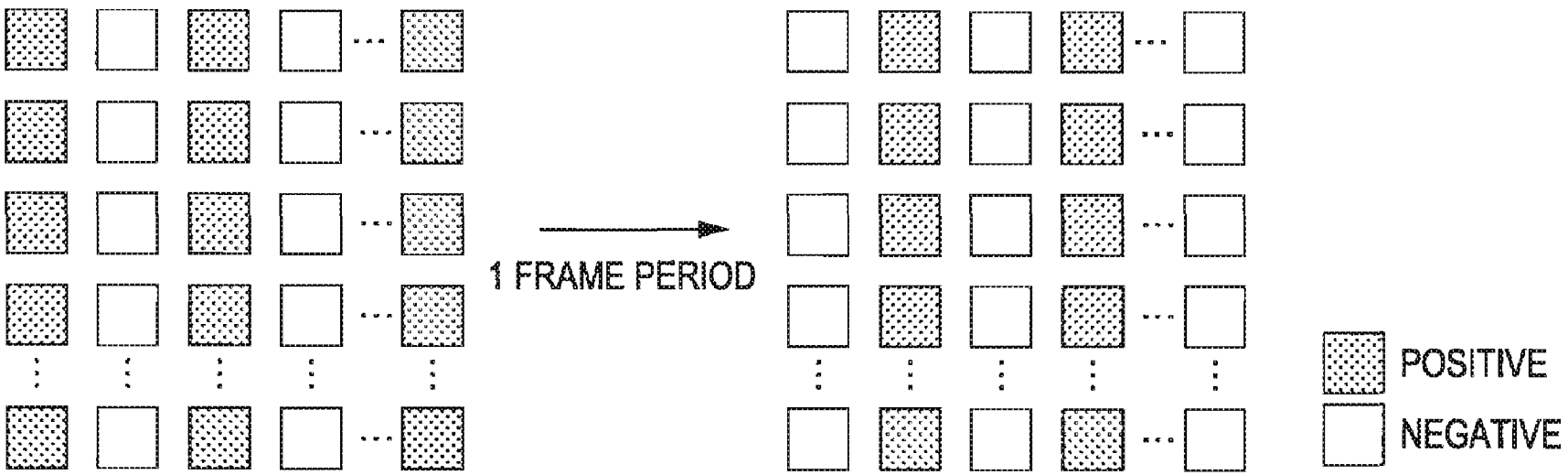
FIG. 17 is an illustration of relative polarities in pixels in source-line inversion driving.

Therefore, as shown in FIG. 17, in all the pixels, for each column, the polarity of a voltage applied to pixels forming the row is opposite. After one frame period passes, the polarity of the voltage applied to the pixels is inverted.

In the above-described manner, the source-line inversion-driving mode is performed, that is, voltages that are relatively identical in polarity are applied to a set of pixels forming an arbitrary column among the plurality of pixels, and voltages that are relatively opposite in polarity are applied to sets of pixels forming two columns adjacent to the arbitrary column.

As described above, by applying voltages to the plurality of pixels on the basis of the source-line inversion-driving mode, two adjacent pixels in the row direction have a large potential difference since voltages having opposite polarities are applied to two adjacent columns. Accordingly, similarly to the above-described gate-line inversion-driving mode, a strong horizontal electric field is generated between adjacent pixels in the row direction, so that disclination can easily occur in liquid crystals. This easily generates a transition nucleus in which alignment has changed from the splay alignment to the bend alignment.

In the source-line inversion-driving mode, voltages having identical polarities are applied to pixels forming the same column. Thus, two adjacent pixels in the column direction have a small potential difference. Accordingly, the alignment state of the generated transition nucleus is conducted in the column direction, with the generated transition nucleus as a base. Specifically, the generated transition nucleus grows in the column direction. In the source-line inversion-driving mode, as described above, it is difficult for the above alignment state to be conducted in the row direction since two adjacent pixels in the row direction have a large potential difference.

The switching unit 44 generates count signal COUNT that is counted up whenever vertical synchronizing signal VSYNC is generated. When the switching unit 44 counts 30 vertical synchronizing signals VSYNC, that is, when 30 frame periods (0.5 seconds) pass, the switching unit 44 switches the inversion driving mode selected by the inversion driving unit 43 from the source-line inversion-driving mode to the gate-line inversion-driving mode. In this manner, the inversion driving mode is switched. During the 30 frame periods until the inversion driving mode is switched by the switching unit 44, sufficient transition nuclei are generated in the plurality of pixels. In addition, the alignment state of each transition nucleus is conducted in the column direction, with the transition nucleus as a base.

Figure 15:
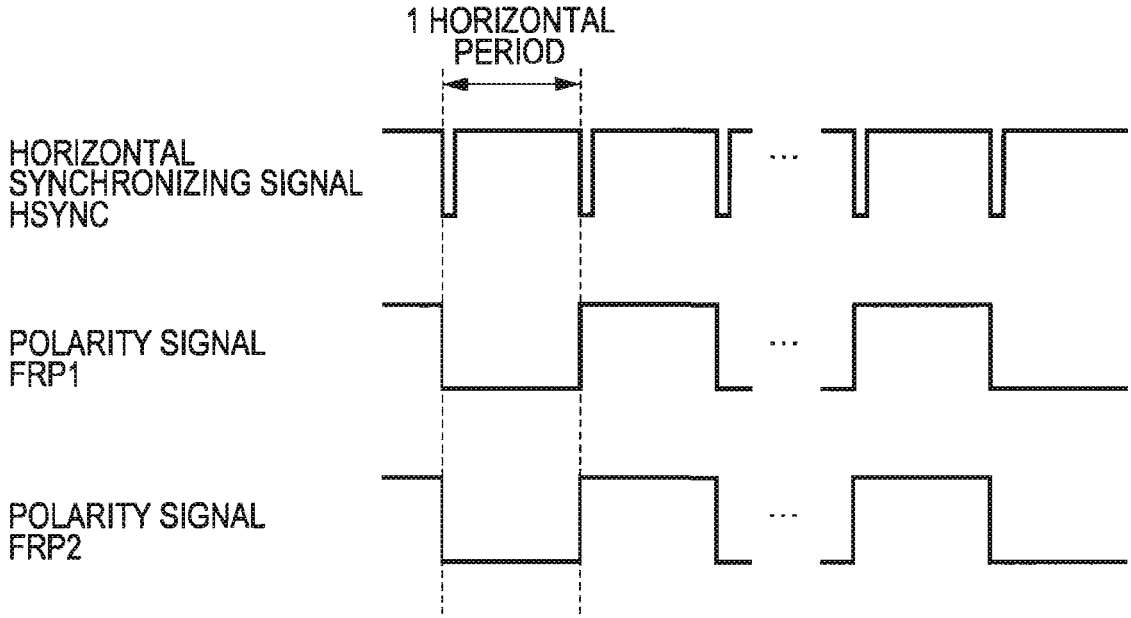
FIG. 15 is a timing chart showing polarity signals in gate-line inversion driving.

Next, the gate-line inversion-driving step is performed. In the gate-line inversion-driving step, voltages are applied to the plurality of pixels on the basis of the gate-line inversion-driving mode. As shown in FIG. 15, first and second polarity signals FRP1 and FRP2 perform toggling operations in each of which the signal polarity is inverted whenever horizontal synchronizing signal HSYNC is input. In addition, first and second polarity signals FRP1 and FRP2 are identical in polarity. When the switching unit 44 counts 60 vertical synchronizing signals VSYNC, that is, when 60 frame periods (one second) from the start of the initial transition step, the initial transition step finishes. During the 30 frame periods (0.5 seconds) after the inversion driving mode is switched to the gate-line inversion-driving mode by the switching unit 44, the alignment state of the transition nucleus generated in the source-line inversion-driving step and conducted in the column direction is conducted in the row direction. This conducts the alignment state of the transition nucleus to all the pixels. As described above, a transition of the alignment of liquid crystal in all the pixels from the splay alignment to the bend alignment is performed.

After that, the image display step is performed, with the gate-line inversion-driving mode selected.

As described above, the liquid crystal display according to the third embodiment, the liquid crystal device driving method, and the electronic apparatus also produce operation and advantages similar to those in the first embodiment.

In the third embodiment, similarly to the above-described second embodiment, the initial transition step may be switched from the gate-line inversion-driving step to the source-line inversion-driving step.

Fourth Embodiment

Next, a liquid crystal display according to a fourth embodiment of the invention, a method for driving the liquid crystal device, and an electronic apparatus including the liquid crystal device are described below. In the fourth embodiment, the liquid-crystal-device driving method differs from that in the first embodiment. Accordingly, differences are mainly described below, and the components described in the first embodiment are not described since they are denoted by identical reference numerals.

The liquid crystal device according to the fourth embodiment includes a dot inversion-driving mode and a frame inversion-driving mode as two types of inversion driving modes.

On the basis of clock signal CLK, horizontal synchronizing signal HSYNC, and vertical synchronizing signal VSYNC input from the external circuit (not shown) connected through the external mounting terminals 22, the inversion driving unit 43 can generate first and second polarity signals FRP1 and FRP2, data-line-driving-circuit start signal DX, data-line-driving-circuit clock CLX, and scanning-line-driving-circuit clock CLY.

The DA converter 42 can convert digital image signal $D_{data}$ input from the inversion-driving controller 41 from digital to analog form, and can generate analog image signals $A_{data}$ on the basis of first and second polarity signals FRP1 and FRP2 generated by the inversion-driving controller 41. The DA converter 42 can alternately input, to the data lines 13, analog image signal $A_{data}$ generated on the basis of first polarity signal FRP1 and analog image signal $A_{data}$ generated on the basis of second polarity signal FRP2. Analog image signal $A_{data}$ generated on the basis of first polarity signal FRP1 is input to one of two adjacent data lines 13, while analog image signal $A_{data}$ generated on the basis of second polarity signal FRP2 is input to the other data line 13.

Figure 18:
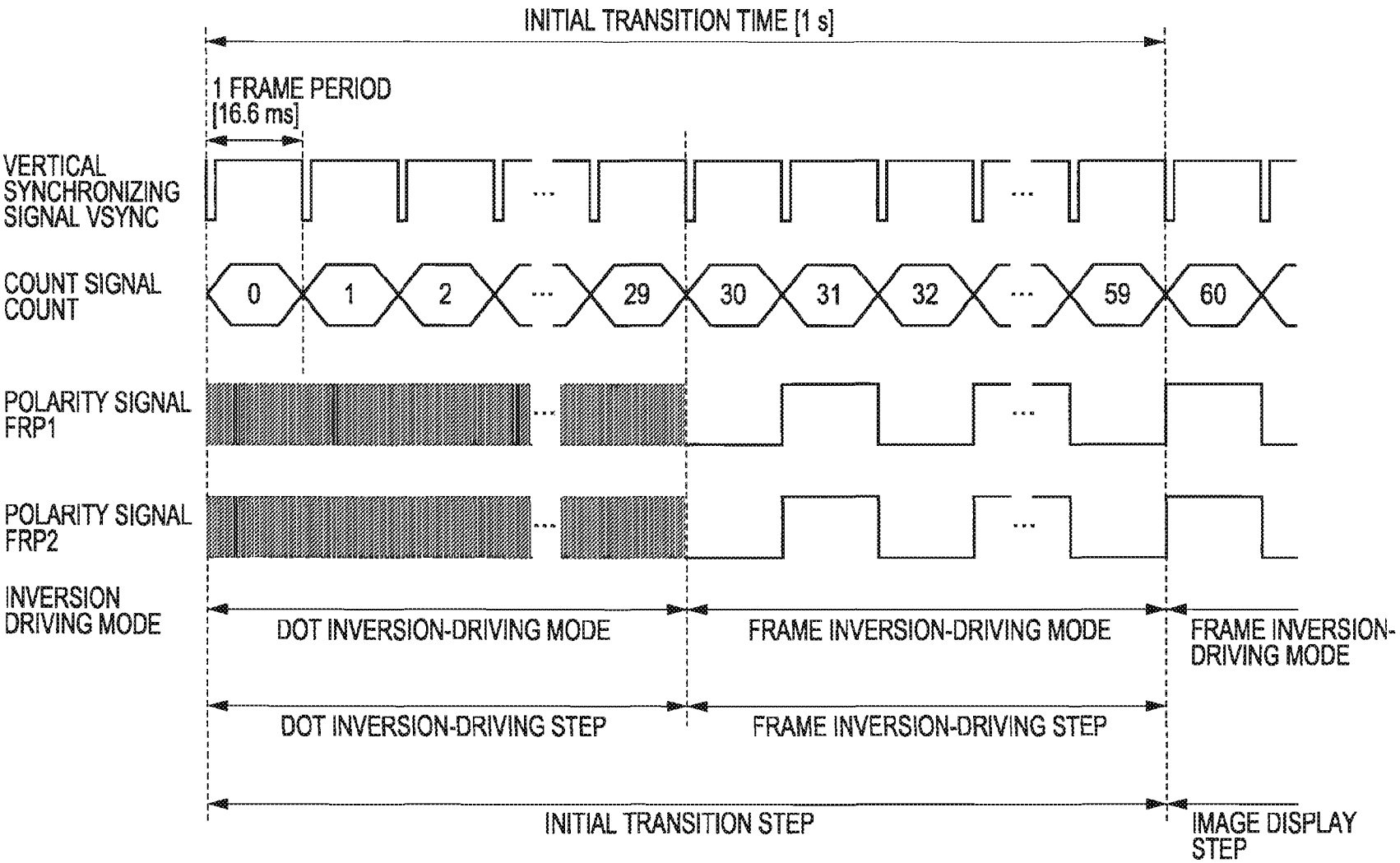
FIG. 18 is a timing chart showing a driving method in a fourth embodiment of the invention.

Next, the liquid-crystal-device driving method is described below. As shown in FIG. 18, an initial transition step in the fourth embodiment includes a dot inversion-driving step and a frame inversion-driving step.

In the dot inversion-driving step, voltages are applied to the pixels on the basis of the dot inversion-driving mode.

Figure 19:
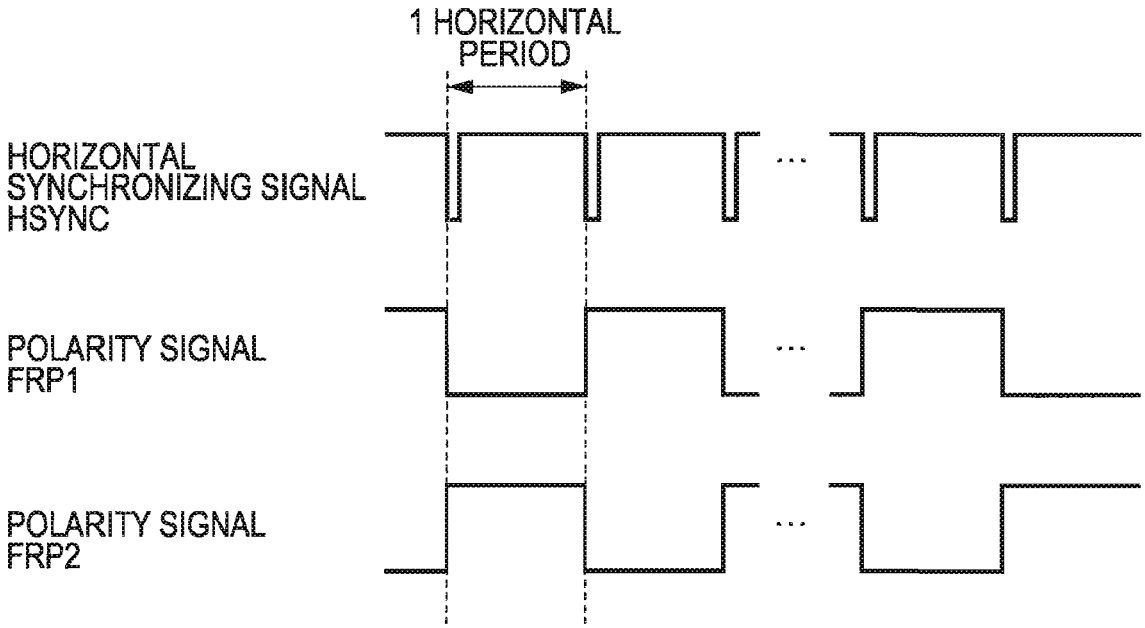
FIG. 19 is a timing chart showing polarity signals in dot inversion driving.

As shown in FIG. 19, first and second polarity signals FRP1 and FRP2 generated in the dot inversion-driving step perform toggling operations in each of which the signal polarity is inverted whenever horizontal synchronizing signal HSYNC is input. In addition, first and second polarity signals FRP1 and FRP2 are opposite in polarity. First and second polarity signals FRP1 and FRP2 alternately correspond to the data lines 13. In other words, first polarity signal FRP1 corresponds to one of two adjacent data lines 13, while second polarity signal FRP2 corresponds to the other data line 13. Accordingly, first and second polarity signals FRP1 and FRP2 generated in the dot inversion-driving step are opposite in polarity between an arbitrary pixel among the plurality of pixels and a different pixel adjacent thereto.

The scanning driving circuits 23 and 24 supply the scanning lines 14 with scanning signals G1, G2, . . . , and Gn on the basis of supplied scanning-line-driving-circuit start signal DY and scanning-line-driving-circuit clock CLY.

The data line driving circuit 21 supplies the data lines 13 with image signals S1, S2, . . . , and Sm on the basis of supplied analog image signal $A_{data}$, data-line-driving-circuit start signal DX, and data-line-driving-circuit clock CLX.

Figure 20:
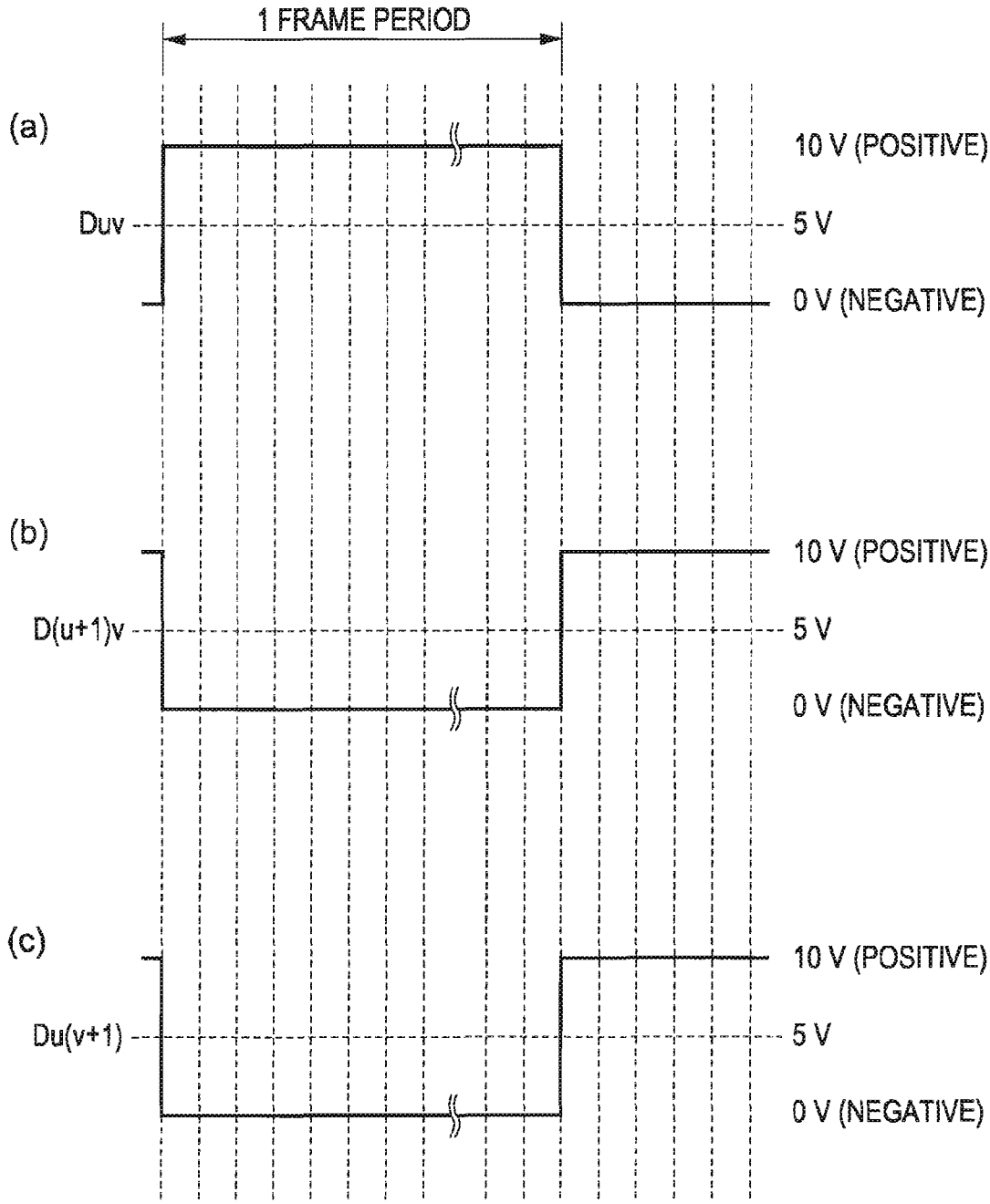
FIG. 20 is a timing chart showing image signals in dot inversion driving.

First and second polarity signals FRP1 and FRP2 supplied to the DA converter 42 allow relative polarities of image signals S1, S2, . . . , and Sm to be opposite between an arbitrary pixel and a different pixel adjacent thereto. Specifically, as shown in portion (a) of FIG. 20, when the polarity of the voltage of an image signal supplied to pixel Duv among the plurality of pixels is inverted for each horizontal period, as shown in portion (b) of FIG. 20, the polarity of an image signal supplied to pixel D(u+1)v adjacent to pixel Duv in the column direction is inverted for each horizontal period. In addition, as shown in portion (c) of FIG. 20, the polarity of the voltage of an image signal supplied to pixel Du(v+1) adjacent to pixel Duv in the row direction is inverted for each horizontal period. In portions (a) to (c) of FIG. 20, actually, there is a slight delay in timing that the voltage is supplied to each pixel. However, the delay is not shown since it is sufficiently small for each frame period.

Figure 21:
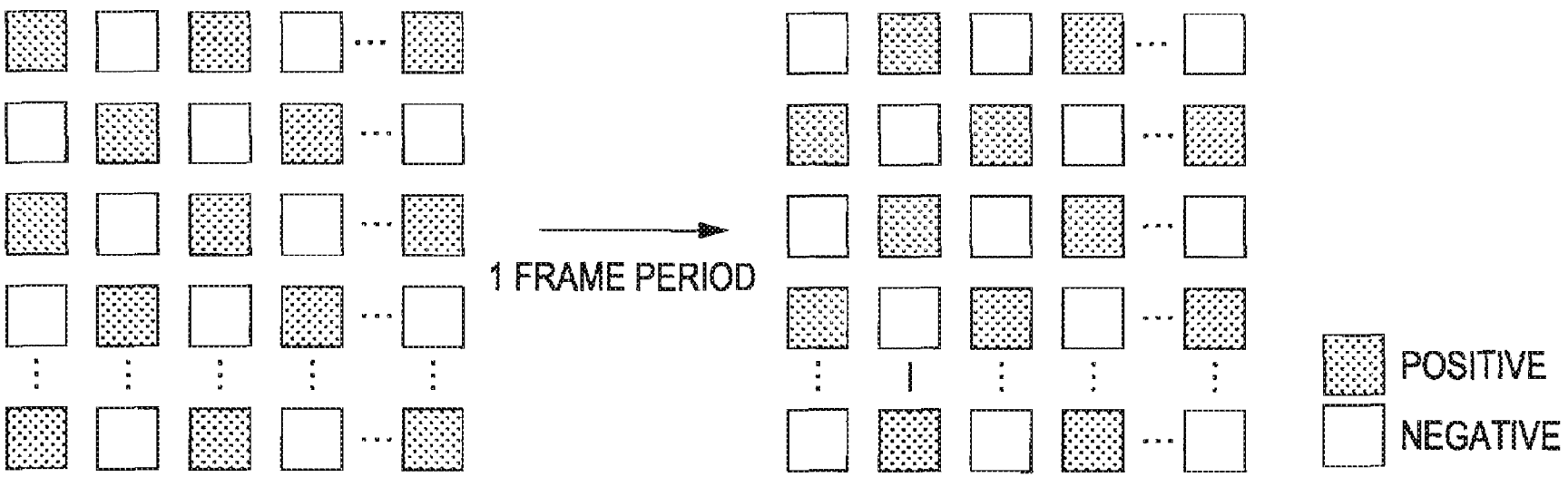
FIG. 21 is an illustration of relative polarities in pixels in dot inversion driving.

Therefore, as shown in FIG. 21, in all the pixels, the voltage applied to each different pixel adjacent to each arbitrary pixel is opposite in polarity. After one horizontal period passes, the voltage applied to the different pixel is inverted.

As described above, the dot inversion-driving mode is performed, in which a voltage is applied to an arbitrary pixel among the plurality of pixels, the voltage being relatively opposite to a voltage applied to a different pixel adjacent to the arbitrary pixel.

As described above, by applying voltages to the plurality of pixels on the basis of the dot inversion-driving mode, a strong horizontal electric field is generated in the row direction and the column direction since voltages having opposite polarities are applied to two adjacent pixels. This causes disclination to easily occur in liquid crystal. This easily generates a transition nucleus in which the alignment state has changed from the splay alignment to the bend alignment.

In the dot inversion-driving mode, as described above, it is difficult for the alignment state to be conducted, with the generated transition nucleus as a base, since two adjacent pixels have a large potential difference.

The switching unit 44 generates count signal COUNT that is counted up whenever vertical synchronizing signal VSYNC is generated. When the switching unit 44 counts 30 vertical synchronizing signals VSYNC, that is, when 30 frame periods (0.5 seconds) pass, the switching unit 44 switches the inversion driving mode selected by the inversion driving unit 43 from the dot inversion-driving mode to the frame inversion-driving mode. In this manner, the inversion driving mode is switched. During the 30 frame periods (0.5 seconds) until the inversion driving mode is selected, sufficient transition nuclei are generated in the plurality of pixels.

Next, the frame inversion-driving step is performed. In the frame inversion-driving step, voltages are applied on the basis of the frame inversion-driving mode. When the switching unit 44 counts 60 vertical synchronizing signals VSYNC, that is, when 60 frame periods (one seconds) pass from the start of the initial transition step, the initial transition step finishes. During the 30 frame periods (0.5 seconds) after the inversion-driving step is switched to the frame inversion-driving mode by the switching unit 44, the alignment state of the transition nucleus generated in the dot inversion-driving step is conducted to all the plurality of pixels. In the above manner, a transition of the alignment state of liquid crystal in all the pixels from the splay alignment to the bend alignment is performed.

After that, the image display step is performed, with the frame inversion-driving mode selected.

As described above, the liquid crystal display according to the fourth embodiment, the method for driving the liquid crystal device, and the electronic apparatus including the liquid crystal device also produce operation and advantages similar to those in the first embodiment.

Fifth Embodiment

Next, a liquid crystal display according to a fifth embodiment of the invention, a method for driving the liquid crystal device, and an electronic apparatus including the liquid crystal device are described below. In the fifth embodiment, the liquid-crystal-device driving method differs from that in the first embodiment. Accordingly, differences are mainly described below, and the components described in the first embodiment are not described since they are denoted by identical reference numerals.

Figure 22:
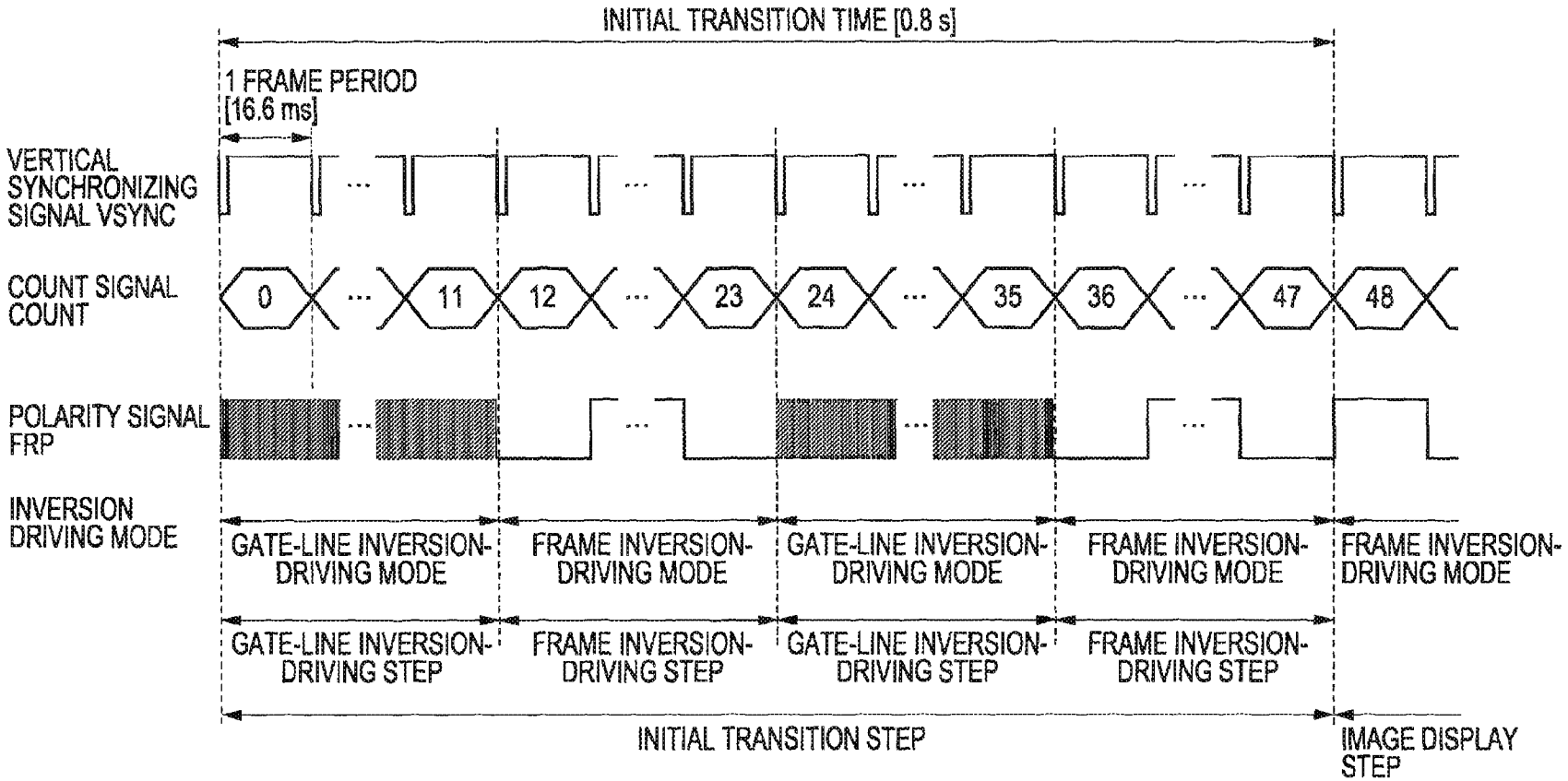
FIG. 22 is a timing chart showing a driving method in a fifth embodiment of the invention.

As shown in FIG. 22, in the liquid-crystal-device driving method according to the fifth embodiment, an initial transition step includes a gate-line inversion-driving step and a frame inversion-driving step. Both steps are repeated twice.

In the gate-line inversion-driving step, voltages are applied to the pixels on the basis of the frame inversion-driving mode. When the switching unit 44 counts 12 vertical synchronizing signals VSYNC, that is, when 12 frame periods (0.2 seconds) pass, the switching unit 44 switches the inversion driving mode selected by the inversion driving unit 43 from the gate-line inversion-driving mode to the frame inversion-driving mode. During 12 frame periods (0.2 seconds) until the inversion driving mode is switched, transition nuclei are generated in the plurality of pixels.

In the frame inversion-driving step, which follows the gate-line inversion-driving mode, voltages are applied to the pixels. At this time, first and second polarity signals FRP1 and FRP2 perform toggling operations in each of which the signal polarity is inverted whenever vertical synchronizing signal VSYNC is input. In addition, first and second polarity signals FRP1 and FRP2 are identical in polarity. When the switching unit 44 counts 24 vertical synchronizing signals VSYNC, that is, 24 frame periods (0.4 seconds) pass from the start of the initial transition step, the switching unit 44 switches the inversion driving mode selected by the inversion driving unit 43 from the frame inversion-driving mode to the gate-line inversion-driving mode. During 12 frame periods (0.2 seconds) pass after the inversion driving mode is switched to the frame inversion-driving mode by the switching unit 44, the alignment state of each transition nucleus generated in the gate-line inversion-driving step is conducted.

Next, in the gate-line inversion-driving mode, which is performed again, when the switching unit 44 counts 36 vertical synchronizing signals VSYNC, that is, when 36 frame periods (0.6 seconds) pass from the start of the initial transition step, the switching unit 44 switches the inversion driving mode selected by the inversion driving unit 43 from the gate-line inversion-driving mode to the frame inversion-driving mode.

In the frame inversion-driving mode, which is performed again, when the switching unit 44 counts 36 vertical synchronizing signals VSYNC, that is, when 36 frame periods (0.6 seconds) pass from the start of the initial transition step, the initial transition step finishes.

After that, the image display step is performed, with the frame inversion-driving mode selected.

As described above, the liquid crystal display according to the fifth embodiment, the method for driving the liquid crystal device, and the electronic apparatus including the liquid crystal device also produce operation and advantages similar to those in the first embodiment.

Sixth Embodiment

Next, a liquid crystal display according to a sixth embodiment of the invention, a method for driving the liquid crystal device, and an electronic apparatus including the liquid crystal device are described below. In the sixth embodiment, the liquid-crystal-device driving method differs from that in the first embodiment. Accordingly, differences are mainly described below, and the components described in the first embodiment are not described since they are denoted by identical reference numerals.

In the liquid crystal device according to the sixth embodiment, the inversion driving unit 43 has three types of inversion driving modes, that is, a gate-line inversion-driving mode, a source-line inversion-driving mode, and a frame inversion-driving mode.

Figure 23:
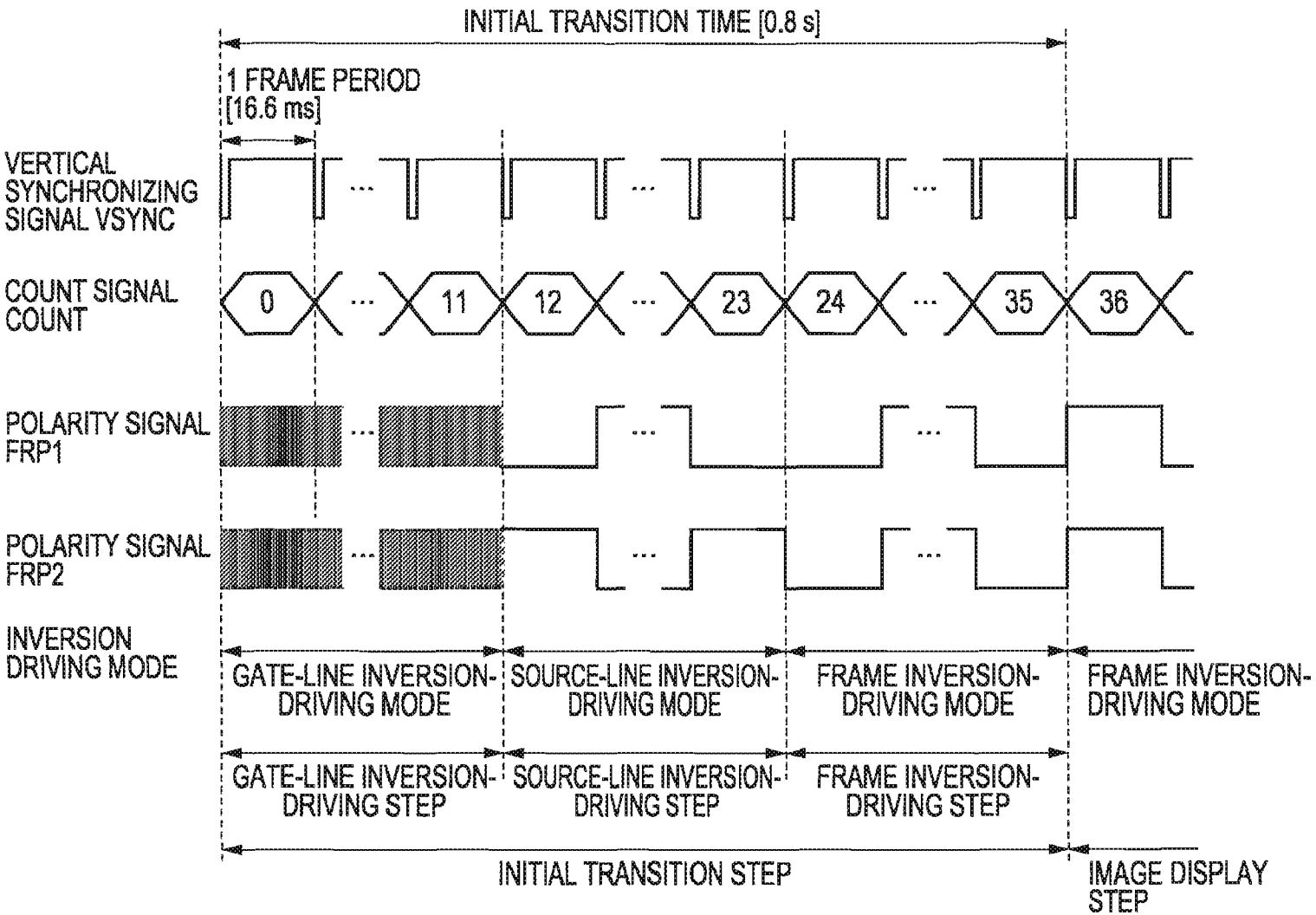
FIG. 23 is a timing chart showing a driving method in a sixth embodiment of the invention.

As shown in FIG. 23, an initial transition step in the sixth embodiment includes the gate-line inversion-driving step, the source-line inversion-driving step, and the frame inversion-driving step.

In the gate-line inversion-driving step, voltages are applied to pixels on the basis of the gate-line inversion-driving mode. When the switching unit 44 counts 12 vertical synchronizing signals VSYNC, that is, when 12 flame periods (0.2 seconds) pass, the switching unit 44 switches the inversion driving mode selected by the inversion driving unit 43 from the gate-line inversion-driving mode to the source-line inversion-driving mode. During 12 frame periods (0.2 seconds) until the inversion driving mode is switched by the switching unit 44, transition nuclei are generated in the plurality of pixels.

In the source-line inversion-driving step, which follows the gate-line inversion-driving mode, voltages are applied to the pixels on the basis of the source-line inversion-driving mode. When the switching unit 44 counts 24 vertical synchronizing signals VSYNC, that is, when 24 frame periods (0.4 seconds) pass from the start of the initial transition step, the switching unit 44 switches the inversion driving mode selected by the inversion driving unit 43 from the source-line inversion-driving mode to the frame inversion-driving mode. During 12 frame periods (0.2 seconds) after the inversion driving mode is switched to the source-line inversion-driving mode by the switching unit 44, sufficient transition nuclei are generated.

In the frame inversion-driving mode, which follows the source-line inversion-driving mode, voltages are applied to the pixels on the basis of the frame inversion-driving mode. When the switching unit 44 counts 36 vertical synchronizing signals VSYNC, that is, when 36 frame periods (0.6 seconds) pass from the start of the initial transition step, the initial transition step finishes. During 12 frame periods (0.2 seconds) after the inversion driving mode is switched to the frame inversion-driving mode by the switching unit 44, alignment states of transition nuclei generated in the gate-line inversion-driving step and the source-line inversion-driving step are conducted to all the plurality of pixels.

After that, the image display step is performed, with the frame inversion-driving mode selected.

The liquid crystal display according to the sixth embodiment, the method for driving the liquid crystal device, and the electronic apparatus including the liquid crystal device also produce operation and advantages similar to those in the first embodiment.

The invention is not limited to the above-described embodiments, but can variously be altered without departing the spirit of the invention.

Although, for example, the drive frequency of each liquid crystal device is 60 hertz and one frame period is 1/60 seconds, the drive frequency and the frame period are not limited to the values and can be altered, if necessary.

As voltages applied to the pixel electrodes 11 and the counter electrode 31, voltages having relatively identical or opposite polarities may be applied on the basis of each inversion driving mode, and may be altered, if necessary.

In the initial transition step, a combination of inversion driving modes, a number of times each inversion driving mode is repeated, a number of times the inversion driving mode is counted, etc., may be altered, if necessary.

In the image display step, image signals are supplied to data lines 13 on the basis of an inversion driving mode at the time the initial transition step finishes. However, image signals may be supplied on the basis of a different inversion driving mode.

In the gate-line inversion-driving mode, voltages having identical polarities are applied to a set of pixels forming an arbitrary row, and voltages having opposite polarities are applied to pixels forming a column adjacent to the arbitrary row. However, the number of rows to which the voltages having identical polarities are applied is not limited to one but may be a plural number. In other words, voltages having identical polarities may be applied in units of a plurality of rows. Similarly, also in the source-line inversion-driving step, the number of columns to which voltages having identical polarities are applied is not limited to one, but may be plural.

Although the liquid crystal device in each embodiment includes TFTs as switching elements, the liquid crystal device may include two-terminal elements as switching elements.

Although a cellular phone is used as the electronic apparatus in each embodiment, the electronic apparatus is not limited to the cellular phone. The electronic apparatuses in the embodiments may include an electronic book, a projector, a personal computer, a digital still camera, a television receiver, a view-finder or direct-view-monitor videocassette recorder, a car navigation apparatus, a pager, an electronic notebook, an electronic calculator, a workstation, a video phone, a POS (point of sale) terminal, a PDA (personal digital assistant), and an apparatus with a touch panel, if each includes a display unit using the liquid crystal device (or an electro-optic device) according to each embodiment.

What is claimed is:

1. A method for driving a liquid crystal device having an optically compensated bend mode and including an image display area including a plurality of pixel electrodes two-dimensionally arranged (1) in a row direction in which a plurality of scanning lines extend and (2) in a column direction in which a plurality of data lines extend and including a counter electrode opposed to the plurality of pixel electrodes with a liquid crystal being disposed between the plurality of pixel electrodes and the counter electrode, the method comprising:

performing an initial transition of an alignment of the liquid crystal from a splay alignment to a bend alignment, the initial transition including a first inversion driving mode for inverting polarities of voltages applied to the plurality of pixel electrodes relative to a voltage level of the counter electrode, and a second inversion driving mode for switching the first inversion driving mode, the period of the first inversion drive mode being less than or equal to 30 frames, and the period of the first inversion drive mode being 12 or 24 frames, wherein an arrangement of a set of pixel electrodes of the plurality of pixel electrodes in which the polarities of voltages applied to the set of pixel electrodes of the plurality of pixel electrodes relative to the voltage level of the counter electrode are the same for each pixel electrode of the set of pixel electrodes of the plurality of pixel electrodes in the second inversion driving mode is different from an arrangement in the first inversion driving mode, the first inversion driving mode and the second inversion driving mode are executed sequentially during the initial transition, one of the first and second inversion driving modes is a frame inversion-driving mode for applying voltages having relatively identical polarities to all the plurality of pixel electrodes, and the other of the first and second inversion driving modes is a different inversion driving mode.

2. The method according to claim 1, the first and the second inversion driving modes being selected from among:

a gate-line inversion-driving mode for applying voltages having relatively identical polarities to, among, the plurality of pixel electrodes, a set of pixel electrodes forming one row, and applying voltages having relatively opposite polarities to sets of pixel electrodes forming two different rows adjacent to the one row;

a source-line inversion-driving mode for applying voltages having relatively identical polarities to, among the plurality of pixel electrodes, a set of pixel electrodes forming one column, and applying voltages having relatively opposite polarities to sets of pixel electrodes forming two different columns adjacent to the one column;

the frame inversion-driving mode for applying voltages having relatively identical polarities to all the plurality of pixel electrodes; and a dot inversion-driving mode for applying voltages having relatively opposite polarities to pixel electrodes adjacent to one pixel electrode among the plurality of pixel electrodes.

3. The method according to claim 2, the first and the second inversion driving modes including the gate-line inversion-driving mode and the frame inversion-driving mode; and during the initial transition, the gate-line inversion-driving mode is switched to the frame inversion-driving mode.

4. A liquid crystal device including an image display area including a plurality of pixel electrodes two-dimensionally arranged (1) in a row direction in which a plurality of scanning lines extend and (2) in a column direction in which a plurality of data lines extend and a counter electrode opposed to the plurality of pixel electrodes with a liquid crystal being disposed between the plurality of pixel electrodes and the counter electrode, the liquid crystal device having an optically compensated bend mode for displaying an image by performing an initial transition of an alignment of the liquid crystal from a splay alignment to a bend alignment, the liquid crystal device comprising:

an inversion driving unit that has a plurality of inversion driving modes for periodically inverting polarities of voltages applied to the plurality of pixel electrodes relative to a voltage level of the counter electrode, in one of the plurality of inversion driving modes, an arrangement of a set of pixel electrodes of the plurality of pixel electrodes in which the polarities of voltages applied to the set of pixel electrodes of the plurality of pixel electrodes relative to the voltage level of the counter electrode are the same for each electrode of the set of pixel electrodes of the plurality of pixel electrodes being different from an arrangement among a remainder of the plurality of inversion driving modes; and a switching unit that switches among the plurality of inversion driving modes at least once during a time of transition from the splay alignment to the bend alignment, wherein the switching unit switches between a first inversion driving mode and a second inversion driving mode, so that the first inversion driving mode and the second inversion driving mode are executed sequentially during the time of transition, the period of the first inversion drive mode being less than or equal to 30 frames, and the period of the first inversion drive mode being 12 or 24 frames, one of the first and second inversion driving modes is a frame inversion-driving mode for applying voltages having relatively identical polarities to all the plurality of pixel electrodes, and the other of the first and second inversion driving modes is a different inversion driving mode.

5. An electronic apparatus including:

a housing having the liquid crystal device as set forth in claim 4 disposed inside the housing.

* * * * *